US011634931B2

(12) United States Patent
Tagtow et al.

(10) Patent No.: US 11,634,931 B2
(45) Date of Patent: Apr. 25, 2023

(54) MODULAR ELECTRONIC DEADBOLT SYSTEMS

(71) Applicant: Amesbury Group, Inc., Amesbury, MA (US)

(72) Inventors: Gary E. Tagtow, Sioux Falls, SD (US); Michael Lee Anderson, Sioux Falls, SD (US); Tracy Lammers, Sioux Falls, SD (US); Bruce Hagemeyer, Pella, IA (US); Douglas John Criddle, Sioux Falls, SD (US)

(73) Assignee: Amesbury Group, Inc., Edina, MN (US)

( * ) Notice: Subject to any disclaimer, the term of this patent is extended or adjusted under 35 U.S.C. 154(b) by 406 days.

(21) Appl. No.: 16/881,252

(22) Filed: May 22, 2020

(65) Prior Publication Data

US 2020/0354990 A1 Nov. 12, 2020

Related U.S. Application Data

(63) Continuation of application No. 15/954,940, filed on Apr. 17, 2018, now Pat. No. 10,662,675.
(Continued)

(51) Int. Cl.
*E05B 51/00* (2006.01)
*E05B 47/00* (2006.01)
(Continued)

(52) U.S. Cl.
CPC ..... *E05B 47/0012* (2013.01); *E05B 9/002* (2013.01); *E05B 47/026* (2013.01);
(Continued)

(58) Field of Classification Search
CPC ..... E05B 47/0012; E05B 2047/0016; E05B 2047/0023; E05B 2047/0095;
(Continued)

(56) References Cited

U.S. PATENT DOCUMENTS 333,093 A 12/1885 Wright
419,384 A 1/1890 Towne
(Continued)

FOREIGN PATENT DOCUMENTS

AU 84928 12/2020
CA 2631521 11/2009
(Continued)

OTHER PUBLICATIONS

"Intercity Locks—For All Your Security Needs—Fast", http://www.directlocks.co.uk/locks-multipoint-locks-c-123_96.html, accessed Oct. 27, 2011, original publication date unknown, 3 pgs.
(Continued)

*Primary Examiner* — Suzanne L Barrett
(74) *Attorney, Agent, or Firm* — Merchant & Gould P.C.

(57) ABSTRACT

A modular electronic deadbolt includes a bolt module having a first housing defining a first longitudinal axis, a motor disposed in the first housing, and a deadbolt configured to be linearly moveable in relation to the first housing along the first longitudinal axis by the motor. The modular electronic deadbolt also includes a battery module configured to be operatively coupled to the bolt module. The battery module includes a second housing configured to receive a power source, and a face plate coupled to the second housing. The faceplate defines a second longitudinal axis and includes an extension that extends along the second longitudinal axis. The extension is configured to removably couple the bolt module to the battery module such that the first longitudinal axis is substantially orthogonal to the second longitudinal axis.

20 Claims, 13 Drawing Sheets

Related U.S. Application Data

(60) Provisional application No. 62/486,659, filed on Apr. 18, 2017.

(51) Int. Cl.
*E05B 63/00* (2006.01)
*E05B 9/00* (2006.01)
*E05B 47/02* (2006.01)

(52) U.S. Cl.
CPC ..... *E05B 51/00* (2013.01); *E05B 63/0056* (2013.01); *E05B 2047/0016* (2013.01); *E05B 2047/0023* (2013.01); *E05B 2047/0054* (2013.01); *E05B 2047/0058* (2013.01); *E05B 2047/0081* (2013.01); *E05B 2047/0095* (2013.01); *E05Y 2201/434* (2013.01); *E05Y 2201/70* (2013.01); *E05Y 2400/612* (2013.01); *E05Y 2400/65* (2013.01); *E05Y 2400/66* (2013.01); *E05Y 2400/85* (2013.01); *E05Y 2900/132* (2013.01)

(58) Field of Classification Search
CPC ..... E05B 2047/0054; E05B 2047/0058; E05B 2047/0081; E05B 51/00; E05B 47/026; E05B 9/002; E05B 63/0056; E05Y 2201/434; E05Y 2201/70; E05Y 2400/612; E05Y 2400/65; E05Y 2400/66; E05Y 2400/85; E05Y 2900/132
USPC ..... 70/278.1–283
See application file for complete search history.

(56) References Cited

U.S. PATENT DOCUMENTS 651,947 A 6/1900 Johnson
738,280 A 9/1903 Bell et al.
932,330 A 8/1909 Rotchford
958,880 A 5/1910 Lawson
966,208 A 8/1910 Hoes
972,769 A 10/1910 Lark
980,131 A 12/1910 Shean
998,642 A 7/1911 Shean
1,075,914 A 10/1913 Hoes
1,094,143 A 4/1914 Hagstrom
1,142,463 A 6/1915 Shepherd
1,174,652 A 3/1916 Banks
1,247,052 A 11/1917 Wilson
1,251,467 A 1/1918 Blixt et al.
1,277,174 A 8/1918 Bakst
1,359,347 A 11/1920 Fleisher
1,366,909 A 2/1921 Frommer
1,368,141 A 2/1921 Hagstrom
1,529,085 A 3/1925 Preble
1,574,023 A 2/1926 Crompton et al.
1,596,992 A 8/1926 Ognowicz
1,646,674 A 10/1927 Angelillo
1,666,654 A 4/1928 Hiering
1,716,113 A 6/1929 Carlson
1,974,253 A 9/1934 Sandor
2,535,947 A 12/1950 Newell
2,729,089 A 1/1956 Pelcin
2,739,002 A 3/1956 Johnson
2,862,750 A 12/1958 Minke
2,887,336 A 5/1959 Meyer
2,905,493 A 9/1959 Tocchetto
3,064,462 A 11/1962 Ng et al.
3,083,560 A 4/1963 Scott
3,124,378 A 3/1964 Jackson
3,157,042 A 11/1964 Wolz
3,162,472 A 12/1964 Rust
3,214,947 A 11/1965 Wikkerink
3,250,100 A 5/1966 Cornaro
3,332,182 A 7/1967 Mark
3,378,290 A 4/1968 Sekulich
3,413,025 A 11/1968 Sperry
3,437,364 A 4/1969 Walters
RE26,677 E 10/1969 Russell et al.
3,498,657 A 3/1970 Fontana Giampiero
3,578,368 A 5/1971 Dupuis
3,586,360 A 6/1971 Perrotta
3,617,080 A 11/1971 Miller
3,670,537 A 6/1972 Horgan, Jr.
3,792,884 A 2/1974 Tutikawa
3,806,171 A 4/1974 Fernandez
3,899,201 A 8/1975 Paioletti
3,904,229 A 9/1975 Waldo
3,919,808 A 11/1975 Simmons
3,933,382 A 1/1976 Counts
3,940,886 A 3/1976 Ellingson, Jr.
3,953,061 A 4/1976 Hansen et al.
4,076,289 A 2/1978 Fellows et al.
4,116,479 A 9/1978 Poe
4,130,306 A 12/1978 Brkic
4,132,438 A 1/1979 Guymer
4,135,377 A 1/1979 Kleefeldt
4,146,994 A 4/1979 Williams
4,236,396 A 12/1980 Surko et al.
4,273,368 A 6/1981 Tanaka
4,283,882 A 8/1981 Hubbard
4,288,944 A 9/1981 Donovan
4,362,328 A 12/1982 Tacheny
4,365,490 A 12/1982 Manzoni
4,372,594 A 2/1983 Gater
4,476,700 A 10/1984 King
4,500,122 A 2/1985 Douglas
4,547,006 A 10/1985 Castanier
4,548,432 A 10/1985 Bengtsson
4,593,542 A 6/1986 Rotondi et al.
4,595,220 A 6/1986 Hatchett, Jr.
4,602,490 A 7/1986 Glass
4,602,812 A 7/1986 Bourner
4,607,510 A 8/1986 Shanaan et al.
4,633,688 A 1/1987 Beudat
4,639,025 A 1/1987 Fann
4,643,005 A 2/1987 Logas
4,691,543 A 9/1987 Watts
4,704,880 A 11/1987 Schlindwein
4,706,512 A 11/1987 McKernon et al.
4,717,909 A 1/1988 Davis
4,754,624 A 7/1988 Fleming et al.
4,768,817 A 9/1988 Fann
4,799,719 A 1/1989 Wood
4,893,849 A 1/1990 Schlack
4,913,475 A 4/1990 Bushnell et al.
4,949,563 A 8/1990 Gerard et al.
4,961,602 A 10/1990 Pettersson
4,962,653 A 10/1990 Kaup
4,962,800 A 10/1990 Owiriwo
4,964,660 A 10/1990 Prevot et al.
4,973,091 A 11/1990 Paulson
5,077,992 A 1/1992 Su
5,092,144 A 3/1992 Fleming et al.
5,114,192 A 5/1992 Toledo
5,118,151 A 6/1992 Nicholas, Jr. et al.
5,125,703 A 6/1992 Clancy et al.
5,148,691 A 9/1992 Wallden
5,171,050 A 12/1992 Mascotte
5,172,944 A 12/1992 Munich et al.
5,184,852 A 2/1993 O'Brien
5,193,861 A 3/1993 Juga
5,197,771 A 3/1993 Kaup et al.
5,257,841 A 11/1993 Geringer
5,265,452 A 11/1993 Dawson et al.
5,290,077 A 3/1994 Fleming
5,364,138 A 11/1994 Dietrich
5,373,716 A 12/1994 MacNeil et al.
5,382,060 A 1/1995 O'Toole et al.
5,388,875 A 2/1995 Fleming
5,394,718 A 3/1995 Hotzi
5,404,737 A 4/1995 Hotzl
5,441,315 A 8/1995 Kleefeldt
5,456,503 A 10/1995 Russell et al.

(56) References Cited

U.S. PATENT DOCUMENTS 5,482,334 A 1/1996 Hotzl
5,495,731 A 3/1996 Riznik
5,496,082 A 3/1996 Zuckerman
5,498,038 A 3/1996 Simon
5,513,505 A 5/1996 Danes
5,516,160 A 5/1996 Kajuch
5,524,941 A 6/1996 Fleming
5,524,942 A 6/1996 Fleming
5,531,086 A 7/1996 Bryant
5,544,924 A 8/1996 Paster
5,546,777 A 8/1996 Liu
5,603,534 A 2/1997 Fuller
5,609,372 A 3/1997 Ponelle
5,620,216 A 4/1997 Fuller
5,628,216 A 5/1997 Qureshi
5,707,090 A 1/1998 Sedley
5,716,154 A 2/1998 Miller et al.
5,722,704 A 3/1998 Chaput et al.
5,728,108 A 3/1998 Griffiths et al.
5,735,559 A 4/1998 Frolov
5,757,269 A 5/1998 Roth
5,782,114 A 7/1998 Zeus et al.
5,791,179 A 8/1998 Brask
5,791,700 A 8/1998 Biro
5,820,170 A 10/1998 Clancy
5,820,173 A 10/1998 Fuller
5,825,288 A 10/1998 Wojdan
5,865,479 A 2/1999 Viney
5,878,606 A 3/1999 Chaput et al.
5,890,753 A 4/1999 Fuller
5,896,763 A 4/1999 Dinkelborg et al.
5,901,989 A 5/1999 Becken et al.
5,906,403 A 5/1999 Bestler et al.
5,911,460 A 6/1999 Hawkins
5,911,763 A 6/1999 Quesada
5,915,764 A 6/1999 MacDonald
5,918,916 A 7/1999 Kajuch
5,931,430 A 8/1999 Palmer
5,946,956 A 9/1999 Hotzl
5,951,068 A 9/1999 Strong et al.
5,979,199 A 11/1999 Elpern
6,050,115 A 4/2000 Schroter et al.
6,079,585 A 6/2000 Lentini
6,089,058 A 7/2000 Elpern
6,094,869 A 8/2000 Magoon et al.
6,098,433 A 8/2000 Manaici
6,112,563 A 9/2000 Ramos
6,116,067 A 9/2000 Myers
6,119,538 A 9/2000 Chang
6,120,071 A 9/2000 Picard
D433,916 S 11/2000 Frey
6,145,353 A 11/2000 Doucet
6,147,622 A 11/2000 Fonea
6,148,650 A 11/2000 Kibble
6,174,004 B1 1/2001 Picard et al.
6,196,599 B1 3/2001 D'Hooge
6,209,931 B1 4/2001 Von Stoutenborough et al.
6,217,087 B1 4/2001 Fuller
6,250,842 B1 6/2001 Kruger
6,257,030 B1 7/2001 Davis, III et al.
6,264,252 B1 7/2001 Clancy
6,266,981 B1 7/2001 von Resch et al.
6,282,929 B1 9/2001 Eller et al.
6,283,516 B1 9/2001 Viney
6,293,598 B1 9/2001 Rusiana
6,318,769 B1 11/2001 Kang
6,327,881 B1 12/2001 Grundler et al.
6,389,855 B2 5/2002 Renz et al.
6,441,735 B1 8/2002 Marko
6,443,506 B1 9/2002 Su
6,453,616 B1 9/2002 Wright
6,454,322 B1 9/2002 Su
6,457,751 B1 10/2002 Hartman
6,490,895 B1 12/2002 Weinerman
6,502,435 B2 1/2003 Watts et al.
6,516,641 B1 2/2003 Segawa
6,517,127 B1 2/2003 Lu et al.
6,540,268 B2 4/2003 Pauser
6,564,596 B2 5/2003 Huang
6,568,726 B1 5/2003 Caspi
6,580,355 B1 6/2003 Milo
6,619,085 B1 9/2003 Hsieh
6,637,784 B1 10/2003 Hauber
6,672,632 B1 1/2004 Speed et al.
6,688,656 B1 2/2004 Becken
6,725,693 B2 4/2004 Yu et al.
6,733,051 B1 5/2004 Cowper
6,776,441 B2 8/2004 Liu
6,810,699 B2 11/2004 Nagy
6,813,916 B2 11/2004 Chang
6,871,451 B2 3/2005 Harger et al.
6,905,152 B1 6/2005 Hudson
6,929,293 B2 8/2005 Tonges
6,935,662 B1 8/2005 Hauber et al.
6,945,572 B1 9/2005 Hauber
6,962,377 B2 11/2005 Tonges
6,971,686 B2 12/2005 Becken
6,994,383 B2 2/2006 Morris
7,000,959 B2 2/2006 Sanders
7,010,945 B2 3/2006 Yu
7,010,947 B2 3/2006 Milo
7,025,394 B1 4/2006 Hunt
7,032,418 B2 4/2006 Martin
7,052,054 B2 5/2006 Luker
7,083,206 B1 8/2006 Johnson
7,128,350 B2 10/2006 Eckerdt
7,152,441 B2 12/2006 Friar
7,155,946 B2 1/2007 Lee et al.
7,203,445 B2 4/2007 Uchida
7,207,199 B2 4/2007 Smith et al.
7,249,791 B2 7/2007 Johnson
7,261,330 B1 8/2007 Hauber
7,353,637 B2 4/2008 Harger et al.
7,404,306 B2 7/2008 Walls et al.
7,410,194 B2 8/2008 Chen
7,418,845 B2 9/2008 Timothy
7,513,540 B2 4/2009 Hagemeyer et al.
7,526,933 B2 5/2009 Meekma
7,634,928 B2 12/2009 Hunt
7,637,540 B2 12/2009 Chiang
7,677,067 B2 3/2010 Riznik et al.
7,686,207 B1 3/2010 Jeffs
7,707,862 B2 5/2010 Walls et al.
7,726,705 B2 6/2010 Kim
7,735,882 B2 6/2010 Abdollahzadeh et al.
7,748,759 B2 7/2010 Chen
7,856,856 B2 12/2010 Shvartz
7,878,034 B2 2/2011 Alber et al.
7,946,080 B2 5/2011 Ellerton
7,963,573 B2 6/2011 Blomqvist
8,079,240 B2 12/2011 Brown et al.
8,161,780 B1 4/2012 Huml
8,182,002 B2 5/2012 Fleming
8,325,039 B2 12/2012 Picard
8,348,308 B2 1/2013 Hagemeyer et al.
8,376,414 B2 2/2013 Nakanishi et al.
8,376,415 B2 2/2013 Uyeda
8,382,166 B2 2/2013 Hagemeyer et al.
8,382,168 B2 2/2013 Carabalona
8,398,126 B2 3/2013 Nakanishi et al.
8,403,376 B2 3/2013 Greiner
8,494,680 B2 7/2013 Sparenberg et al.
8,550,506 B2 10/2013 Nakanishi
8,567,631 B2 10/2013 Brunner
8,628,126 B2 1/2014 Hagemeyer et al.
8,646,816 B2 2/2014 Dziurdzia
8,839,562 B2 9/2014 Madrid
8,840,153 B2 9/2014 Juha
8,850,744 B2 10/2014 Bauman et al.
8,851,532 B2 10/2014 Gerninger
8,876,172 B2 11/2014 Denison
8,899,635 B2 12/2014 Nakanishi
8,922,370 B2 12/2014 Picard
8,939,474 B2 1/2015 Hagemeyer et al.

(56) References Cited

U.S. PATENT DOCUMENTS

| | | | |
|---|---|---|---|
| 9,428,937 | B2 | 8/2016 | Tagtow et al. |
| 9,482,035 | B2 | 11/2016 | Wolf |
| 9,512,654 | B2 | 12/2016 | Armari et al. |
| 9,605,444 | B2 | 3/2017 | Rickenbaugh |
| 9,637,957 | B2 | 5/2017 | Hagemeyer et al. |
| 9,758,997 | B2 | 9/2017 | Hagemeyer et al. |
| 9,765,550 | B2 | 9/2017 | Hemmingsen et al. |
| 9,790,716 | B2 | 10/2017 | Hagemeyer et al. |
| 9,822,552 | B2 | 11/2017 | Eller et al. |
| 10,087,656 | B1 | 10/2018 | Cannella |
| 10,174,522 | B2 | 1/2019 | Denison |
| 10,240,366 | B2 | 3/2019 | Sotes Delgado |
| 10,246,914 | B2 | 4/2019 | Sieglaar |
| 10,273,718 | B2 | 4/2019 | Cannella |
| 10,400,477 | B2 | 9/2019 | Moon |
| 10,487,544 | B2 | 11/2019 | Ainley |
| 10,662,675 | B2 * | 5/2020 | Tagtow ..... E05B 9/002 |
| 10,738,506 | B2 | 8/2020 | Holmes |
| 10,808,424 | B2 | 10/2020 | Criddle |
| 10,822,836 | B2 | 11/2020 | Nakasone |
| 10,968,661 | B2 * | 4/2021 | Tagtow ..... E05B 47/0012 |
| 11,021,892 | B2 | 6/2021 | Tagtow |
| 11,441,333 | B2 | 9/2022 | Tagtow |
| 2002/0104339 | A1 | 8/2002 | Saner |
| 2003/0024288 | A1 | 2/2003 | Gokcebay et al. |
| 2003/0159478 | A1 | 8/2003 | Nagy |
| 2004/0003633 | A1 | 1/2004 | Alexander |
| 2004/0004360 | A1 | 1/2004 | Huang |
| 2004/0011094 | A1 | 1/2004 | Hsieh |
| 2004/0066046 | A1 | 4/2004 | Becken |
| 2004/0089037 | A1 | 5/2004 | Chang |
| 2004/0107746 | A1 | 6/2004 | Chang |
| 2004/0107747 | A1 | 6/2004 | Chang |
| 2004/0112100 | A1 | 6/2004 | Martin |
| 2004/0145189 | A1 | 7/2004 | Liu |
| 2004/0227349 | A1 | 11/2004 | Denys |
| 2004/0239121 | A1 | 12/2004 | Morris |
| 2005/0029345 | A1 | 2/2005 | Waterhouse |
| 2005/0044908 | A1 | 3/2005 | Min |
| 2005/0050928 | A1 | 3/2005 | Frolov |
| 2005/0103066 | A1 | 5/2005 | Botha et al. |
| 2005/0144848 | A1 | 7/2005 | Harger et al. |
| 2005/0166647 | A1 | 8/2005 | Walls |
| 2005/0180562 | A1 | 8/2005 | Chiang |
| 2005/0229657 | A1 | 10/2005 | Johansson et al. |
| 2006/0043742 | A1 | 3/2006 | Huang |
| 2006/0071478 | A1 | 4/2006 | Denys |
| 2006/0076783 | A1 | 4/2006 | Tsai |
| 2006/0150516 | A1 | 7/2006 | Hagemeyer |
| 2006/0208509 | A1 | 9/2006 | Bodily |
| 2007/0068205 | A1 | 3/2007 | Timothy |
| 2007/0080541 | A1 | 4/2007 | Fleming |
| 2007/0113603 | A1 | 5/2007 | Polster |
| 2007/0170725 | A1 | 7/2007 | Speyer et al. |
| 2007/0259551 | A1 | 11/2007 | Rebel |
| 2008/0000276 | A1 | 1/2008 | Huang |
| 2008/0001413 | A1 | 1/2008 | Lake |
| 2008/0087052 | A1 | 4/2008 | Abdollahzadeh et al. |
| 2008/0092606 | A1 | 4/2008 | Meekma |
| 2008/0093110 | A1 | 4/2008 | Bagung |
| 2008/0141740 | A1 | 6/2008 | Shvartz |
| 2008/0150300 | A1 | 6/2008 | Harger et al. |
| 2008/0156048 | A1 | 7/2008 | Topfer |
| 2008/0156049 | A1 | 7/2008 | Topfer |
| 2008/0157544 | A1 | 7/2008 | Phipps |
| 2008/0178530 | A1 | 7/2008 | Ellerton et al. |
| 2008/0179893 | A1 | 7/2008 | Johnson |
| 2008/0184749 | A1 | 8/2008 | Alber et al. |
| 2008/0191499 | A1 | 8/2008 | Stein |
| 2009/0064737 | A1 | 3/2009 | Fan |
| 2009/0078011 | A1 | 3/2009 | Avni |
| 2009/0218832 | A1 | 9/2009 | Mackle |
| 2009/0314042 | A1 | 12/2009 | Fan |
| 2009/0315669 | A1 | 12/2009 | Lang |
| 2010/0107707 | A1 | 5/2010 | Viviano |
| 2010/0154490 | A1 | 6/2010 | Hagemeyer et al. |
| 2010/0213724 | A1 | 8/2010 | Uyeda |
| 2010/0236302 | A1 | 9/2010 | Uyeda |
| 2010/0313612 | A1 | 12/2010 | Eichenstein |
| 2010/0327610 | A1 | 12/2010 | Nakanishi et al. |
| 2011/0056254 | A1 | 3/2011 | Tsai |
| 2011/0198867 | A1 | 8/2011 | Hagemeyer et al. |
| 2011/0289987 | A1 | 12/2011 | Chiou et al. |
| 2011/0314877 | A1 | 12/2011 | Fang |
| 2012/0001443 | A1 | 1/2012 | Mitchell |
| 2012/0146346 | A1 | 6/2012 | Hagemeyer et al. |
| 2012/0235428 | A1 | 9/2012 | Blacklaws et al. |
| 2012/0306220 | A1 | 12/2012 | Hagemeyer et al. |
| 2013/0019643 | A1 | 1/2013 | Tagtow et al. |
| 2013/0081251 | A1 | 4/2013 | Hultberg |
| 2013/0140833 | A1 | 6/2013 | Hagemeyer et al. |
| 2013/0152647 | A1 | 6/2013 | Terei et al. |
| 2013/0176107 | A1 | 7/2013 | Dumas et al. |
| 2013/0200636 | A1 | 8/2013 | Hagemeyer et al. |
| 2013/0234449 | A1 | 9/2013 | Dery et al. |
| 2013/0276488 | A1 | 10/2013 | Haber |
| 2014/0060127 | A1 | 3/2014 | Hemmingsen et al. |
| 2014/0125068 | A1 | 5/2014 | Hagemeyer et al. |
| 2014/0159387 | A1 | 6/2014 | Hagemeyer et al. |
| 2014/0182343 | A1 | 7/2014 | Talpe |
| 2014/0367978 | A1 | 12/2014 | Geringer |
| 2015/0075233 | A1 | 3/2015 | Pluta |
| 2015/0089804 | A1 | 4/2015 | Picard |
| 2015/0114176 | A1 | 4/2015 | Bisang |
| 2015/0170449 | A1 | 6/2015 | Chandler, Jr. |
| 2015/0176311 | A1 | 6/2015 | Picard |
| 2015/0252595 | A1 | 9/2015 | Hagemeyer et al. |
| 2016/0083976 | A1 | 3/2016 | Rickenbaugh |
| 2016/0094103 | A1 | 3/2016 | Lien |
| 2016/0108650 | A1 | 4/2016 | Hagemeyer et al. |
| 2016/0369525 | A1 | 12/2016 | Tagtow et al. |
| 2018/0023320 | A1 | 1/2018 | McKibben |
| 2018/0051478 | A1 | 2/2018 | Tagtow |
| 2018/0051480 | A1 | 2/2018 | Tagtow |
| 2018/0119462 | A1 | 5/2018 | Hagemeyer |
| 2018/0155962 | A1 | 6/2018 | Mitchell et al. |
| 2018/0298642 | A1 | 10/2018 | Tagtow |
| 2018/0313116 | A1 | 11/2018 | Criddle |
| 2019/0024437 | A1 | 1/2019 | Tagtow |
| 2019/0032368 | A1 | 1/2019 | Welbig et al. |
| 2019/0277062 | A1 | 9/2019 | Tagtow |
| 2020/0149327 | A1 | 5/2020 | Lammers |
| 2020/0370338 | A1 | 11/2020 | Holmes |

FOREIGN PATENT DOCUMENTS

| | | | |
|---|---|---|---|
| CN | 1243908 | | 2/2000 |
| CN | 2554288 | Y | 6/2003 |
| CN | 2595957 | Y | 12/2003 |
| CN | 2660061 | | 12/2004 |
| CN | 201031548 | Y | 3/2008 |
| CN | 202047652 | U | 11/2011 |
| DE | 1002656 | | 2/1957 |
| DE | 1584112 | | 9/1969 |
| DE | 2639065 | | 3/1977 |
| DE | 3032086 | | 3/1982 |
| DE | 3836693 | | 5/1990 |
| DE | 9011216 | | 10/1990 |
| DE | 4224909 | | 2/1993 |
| DE | 29807860 | | 8/1998 |
| DE | 20115378 | U1 | 11/2001 |
| DE | 10253240 | | 5/2004 |
| DE | 202012002743 | U1 | 4/2012 |
| DE | 202013000920 | U1 | 4/2013 |
| DE | 202013000921 | U1 | 4/2013 |
| DE | 202013001328 | U1 | 5/2013 |
| EP | 0007397 | A1 | 2/1980 |
| EP | 0231042 | A2 | 8/1987 |
| EP | 0268750 | | 6/1988 |
| EP | 341173 | | 11/1989 |
| EP | 359284 | | 3/1990 |
| EP | 661409 | | 7/1995 |
| EP | 792987 | | 9/1997 |
| EP | 1106761 | | 6/2001 |

(56) References Cited

FOREIGN PATENT DOCUMENTS

| | | | |
|---|---|---|---|
| EP | 1283318 | | 2/2003 |
| EP | 1449994 | | 8/2004 |
| EP | 1574642 | | 9/2005 |
| EP | 1867817 | | 12/2007 |
| EP | 2128362 | | 12/2009 |
| EP | 2273046 | A2 | 1/2011 |
| EP | 2339099 | A1 | 6/2011 |
| EP | 2450509 | | 5/2012 |
| EP | 2581531 | A1 | 4/2013 |
| EP | 2584123 | A1 | 4/2013 |
| EP | 2584124 | A2 | 4/2013 |
| EP | 2998483 | | 3/2016 |
| EP | 3091152 | A1 | 11/2016 |
| FR | 363424 | | 7/1906 |
| FR | 370890 | | 2/1907 |
| FR | 21883 | E | 4/1921 |
| FR | 1142316 | | 3/1957 |
| FR | 1162406 | A | 9/1958 |
| FR | 1201087 | | 12/1959 |
| FR | 2339723 | | 9/1977 |
| FR | 2342390 | | 9/1977 |
| FR | 2344695 | | 10/1977 |
| FR | 2502673 | | 10/1982 |
| FR | 2848593 | | 2/2005 |
| FR | 3017641 | | 8/2015 |
| GB | 226170 | | 4/1925 |
| GB | 264373 | A | 1/1927 |
| GB | 583655 | | 12/1946 |
| GB | 612094 | A | 11/1948 |
| GB | 1498849 | | 1/1978 |
| GB | 1575900 | | 10/1980 |
| GB | 2051214 | | 1/1981 |
| GB | 2076879 | | 12/1981 |
| GB | 2115055 | A | 9/1983 |
| GB | 2122244 | | 1/1984 |
| GB | 2126644 | | 3/1984 |
| GB | 2134170 | | 8/1984 |
| GB | 2136045 | | 9/1984 |
| GB | 2168747 | | 6/1986 |
| GB | 2196375 | | 4/1988 |
| GB | 2212849 | | 8/1989 |
| GB | 2225052 | | 5/1990 |
| GB | 2230294 | | 10/1990 |
| GB | 2242702 | | 10/1991 |
| GB | 2244512 | | 12/1991 |
| GB | 2265935 | | 10/1993 |
| GB | 2270343 | | 3/1994 |
| GB | 2280474 | | 2/1995 |
| GB | 2318382 | A | 4/1998 |
| GB | 2364545 | | 1/2002 |
| GB | 2496911 | A | 5/2013 |
| IT | 614960 | | 1/1961 |
| JP | 64-083777 | | 3/1989 |
| JP | 2003343141 | | 12/2003 |
| JP | 2006112042 | | 4/2006 |
| JP | 2008002203 | | 1/2008 |
| KR | 2011094706 | | 8/2011 |
| NL | 8105627 | | 7/1983 |
| SE | 309372 | | 3/1969 |
| WO | 96/25576 | | 8/1996 |
| WO | 97/41323 | | 11/1997 |
| WO | 02/33202 | | 4/2002 |
| WO | 2007/104499 | | 9/2007 |
| WO | 2009/059112 | | 5/2009 |
| WO | 2010071886 | | 6/2010 |
| WO | 2015/079290 | | 6/2015 |
| WO | 2020/023652 | | 1/2020 |

OTHER PUBLICATIONS

"Intercity Locks—For All Your Security Needs—Fast", http://www.directlocks.co.uk/locks-multipoint-locks-c-123_96.html?page=2&sort=2A, accessed Oct. 27, 2011, original publication date unknown, 3 pgs.

"Intercity Locks—for All Your Security Needs—Fast", http://www.directlocks.co.uk/locks-multipoint-locks-c-123_96.html?page=3&sort=2A, accessed Oct. 27, 2011, original publication date unknown, 3 pgs.

"LocksOnline.co.uk: Premier Supplier of Security Products", http://www.locksonline.co.uk/acatalog/Maco_multipoint_lock_2_cams_2_shootbolt_attachment.html, accessed Oct. 27, 2011, original publication date unknown, 5 pgs.

"LocksOnline.co.uk: Premier Supplier of Security Products", http://www.locksonline.co.uk/acatalog/upvc_Locks.html, accessed Oct. 27, 2011, original publication date unknown, 6 pgs.

"UPVC Window Hardware and uPVC Door Hardware online", http://www.upvc-hardware.co.uk/, accessed Oct. 27, 2011, original publication date unknown, 2 pgs.

Doorking.com—Electric Locks—Strikes and Deadbolts; printed from https://www.doorking.com/access-control/electricocks-strikes-deadbolts, 2 pages, Feb. 2016.

magneticlocks.net—Electric Strikes and Deadbolts; printed from https://www.magneticlocks.net/electric-strikes-and-deadbolts/electric-strikes.html, 8 pages, Feb. 2016.

PCT International Search Report and Written Opinion in International Application PCT/US2018/027976, dated Jun. 13, 2018, 15 pages.

sdcsecurity.com—Latch and Deadbolt Monitoring Strikes; printed from http://www.sdcsecurity.com/monitor-strike-kits2.htm, 2 pages, Feb. 2016.

PCT International Preliminary Report on Patentability in International Application PCT/US2018/027976, dated Oct. 31, 2019, 9 pages.

* cited by examiner

MODULAR ELECTRONIC DEADBOLT SYSTEMS

CROSS-REFERENCE TO RELATED APPLICATIONS

This application is a continuation application of U.S. patent application Ser. No. 15/954,940, filed on Apr. 17, 2018, now U.S. Pat. No. 10,662,675, which claims priority to and the benefit of U.S. Provisional Patent Application No. 62/486,659, filed Apr. 18, 2017, the disclosures of which are hereby incorporated by reference herein in their entireties.

INTRODUCTION

Deadbolts are operated by a user (e.g., with a key on an outside of the door or a thumbturn on the inside of the door) to secure a door against unwanted intrusions. At least some known deadbolts are motorized, but it can often be difficult to replace the power source in these deadbolts. For example, batteries can be especially difficult to replace if the motorized deadbolts are positioned in a head or a sill of the door.

SUMMARY

In an aspect, the technology relates to a modular electronic deadbolt including: a bolt module including: a first housing defining a first longitudinal axis; a motor disposed in the first housing; and a deadbolt configured to be linearly moveable in relation to the first housing along the first longitudinal axis by the motor; and a battery module configured to be operatively coupled to the bolt module, the battery module including: a second housing configured to receive a power source; and a face plate coupled to the second housing, wherein the faceplate defines a second longitudinal axis, wherein the face plate includes an extension that extends along the second longitudinal axis, and wherein the extension is configured to removably couple the bolt module to the battery module such that the first longitudinal axis is substantially orthogonal to the second longitudinal axis.

In an example, an opening is defined within the extension, and when the bolt module is coupled to the battery module, at least a portion of the first housing extends through the opening. In another example, the second housing includes a spacer positioned adjacent the opening, and when the bolt module is coupled to the battery module, the spacer supports at least a portion of the first housing. In yet another example, the spacer includes a mounting surface having a curved portion. In still another example, the bolt module further includes a mounting plate, and when the bolt module is coupled to the battery module, the mounting plate aligns with the extension. In an example, the modular electronic deadbolt further includes a connector cable operatively coupling the bolt module and the battery module. In another example, the bolt module further includes a leadscrew coupled to the deadbolt, and the motor is configured to drive rotation of the leadscrew to linearly move the deadbolt along the first longitudinal axis. In yet another example, the battery module further includes a battery carrier defining a power source that is removably disposable within the second housing.

In another aspect, the technology relates to a modular electronic deadbolt including: a bolt module including a deadbolt linearly moveable along a first longitudinal axis; and a battery module including a faceplate extending along a second longitudinal axis, wherein the bolt module is configured to be operatively coupled to the battery module in a first configuration and a second configuration, and wherein in the first configuration, the bolt module is coupled to a portion of the faceplate such that the first longitudinal axis is substantially orthogonal to the second longitudinal axis, and in the second configuration, the bolt module is positioned remote from the battery module.

In an example, the bolt module includes a motor and a leadscrew, and the motor is configured to rotate the leadscrew about the first longitudinal axis to drive linear movement of the deadbolt. In another example, the battery module includes a housing coupled to the faceplate and the faceplate includes an extension that extends along the second longitudinal axis, and wherein the bolt module is coupled to the extension in the first configuration. In yet another example, an opening is defined at least partially within the extension, and at least a portion of the bolt module extends through the opening in the first condition. In still another example, the housing includes a spacer positioned adjacent to the opening, and the spacer supports at least a portion of the bolt module in the first condition. In an example, the spacer includes a curved surface that corresponds to the bolt module. In another example, the bolt module further includes a mounting plate, and the mounting plate aligns with the extension in the first condition. In yet another example, the modular electronic deadbolt further includes a connector cable operatively coupling the bolt module and the battery module in both the first condition and the second condition. In still another example, in the second configuration the first longitudinal axis is substantially parallel to the second longitudinal axis.

In another aspect, the technology relates to a method of installing a modular electronic deadbolt onto a door, the method including: mounting a bolt module to a first location on the door, wherein the bolt module includes a deadbolt linearly moveable along a first longitudinal axis by a motor and a leadscrew; mounting a battery module to a second location on the door, wherein the battery module includes a faceplate defining a second longitudinal axis; and operatively connecting the bolt module to the battery module.

In an example, the first location is associated with a first edge of the door and the second location is associated with a second edge of the door that is different than the first edge, and wherein when mounting the bolt module and the battery module to the door, the method further includes positioning the first longitudinal axis substantially parallel to the second longitudinal axis and the bolt module remote from the battery module. In another example, before mounting the bolt module and the battery module to the door, the method includes coupling the bolt module to the battery module such that the first location is adjacent to the second location and both locations are associated with a same edge of the door, wherein the first longitudinal axis is substantially orthogonal to the second longitudinal axis.

BRIEF DESCRIPTION OF THE DRAWINGS

There are shown in the drawings, examples which are presently preferred, it being understood, however, that the technology is not limited to the precise arrangements and instrumentalities shown.

DETAILED DESCRIPTION

Figure 1:
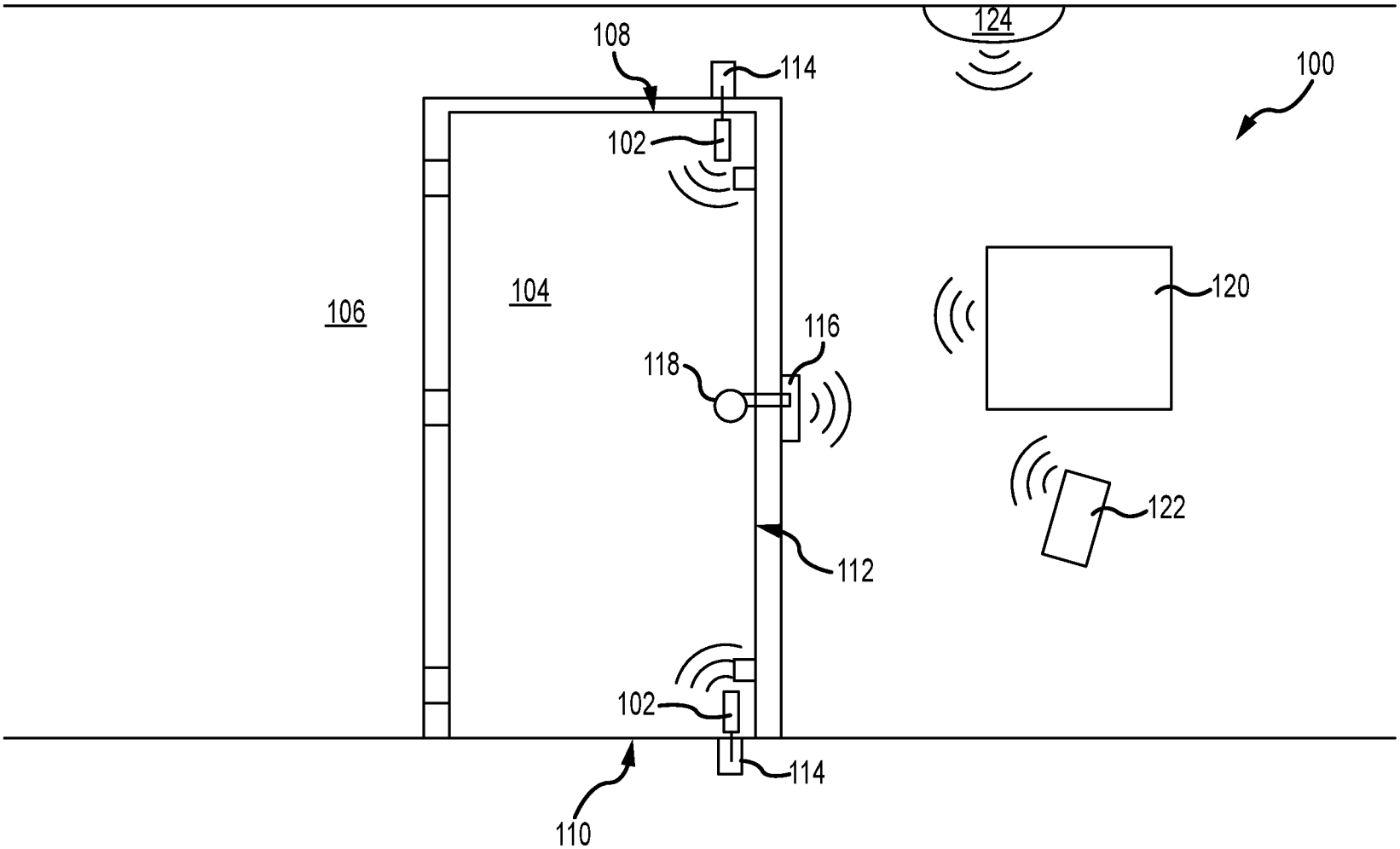
FIG. 1 depicts a schematic view of an electronic door lock system.

FIG. 1 depicts a schematic view of one example of a multi-point electric door lock system 100. The system 100 includes two electronic deadbolt systems 102 installed in a door panel 104, for example, so as to extend into a portion of a frame 106 such as a head and/or a sill thereof. Alternatively, the electronic deadbolt system 102 may be installed in the frame 106 so as to extend into the door 104. Additionally, the placement and number of electronic deadbolt systems 102 may be altered as required or desired for a particular application, for example, in pivoting doors, the electronic deadbolts may be disposed so as to extend from a head 108, a sill 110, or a locking edge 112 (e.g., vertical edge) of the door 104.

In the example, the door panel 104 is a pivoting door; however, the electronic deadbolt systems described herein can be utilized in entry doors, sliding doors, pivoting patio doors, and any other door as required or desired. In sliding patio doors, the electronic deadbolt systems 102 have linearly extending locking elements that may extend from the head 108 or the sill 110 of the sliding door. If utilized on the locking edge 112 of a sliding door, the electronic deadbolt system 102 would require a hook-shaped locking element that would hook about a keeper so as to prevent retraction of the door.

In the example, each electronic deadbolt system 102 is positioned to extend into a keeper 114. The keepers 114 may be standard keepers or electronic keepers as described in U.S. patent application Ser. No. 15/239,714, filed Aug. 17, 2016, entitled "Locking System Having an Electronic Keeper," the disclosure of which is herein incorporated by reference in its entirety. The system 100 also includes an electronic keeper 116 configured to receive a standard (e.g., manually-actuated) deadbolt 118, as typically available on an entry or patio door.

In one example, once the deadbolt 118 is manually actuated into the locking position, the electronic keeper 116 detects a position of the deadbolt 118 therein. A signal may be sent to the remotely located electronic deadbolt systems 102, thus causing actuation thereof. At this point, the door 104 is now locked at multiple points. Unlocking of the manual deadbolt 118 is detected by the electronic keeper 116 (that is, the keeper 116 no longer detects the presence of the deadbolt 118 therein) and a signal is sent to the remote electronic deadbolt systems 102 causing retraction thereof, thus allowing the door 104 to be opened. Thus, the electronic deadbolts described herein may be utilized to create a robust multi-point locking system for a door and to improve the security thereof.

In another example, the system 100 may include a controller/monitoring system, which may be a remote panel 120, which may be used to extend or retract the electronic deadbolt systems 102, or which may be used for communication between the various electronic keepers 114 and deadbolts 102. Alternatively or additionally, an application on a remote computer or smartphone 122 may take the place of, or supplement, the remote panel 120. By utilizing a remote panel 120 and/or a smartphone 122, the electronic deadbolt systems 102 may be locked or unlocked remotely, thus providing multi-point locking ability without the requirement for manual actuation of the deadbolt 118. Additionally, any or all of the components (electronic deadbolt system 102, keeper 116, panel 120, and smartphone 122) may communicate either directly or indirectly with a home monitoring or security system 124. The communication between components may be wireless, as depicted, or may be via wired systems.

The modular electronic deadbolts described herein enable for a single deadbolt assembly to be used in multiple door locations. In one aspect, the modular electronic deadbolts include a separable bolt module and battery module. As such, the bolt module may be mounted with the battery module or remote from the battery module to accommodate different door mounting locations. For example, the bolt module and the battery module may both be mounted to the locking edge of the door, or the bolt module may be mounted to a different door edge than the battery module. This versatility enables the remote deadbolt systems to be configured in the field without any specialized tools. Additionally, the battery module mounting location on the door may be selected such that access to the power source is increased.

Figure 2A:
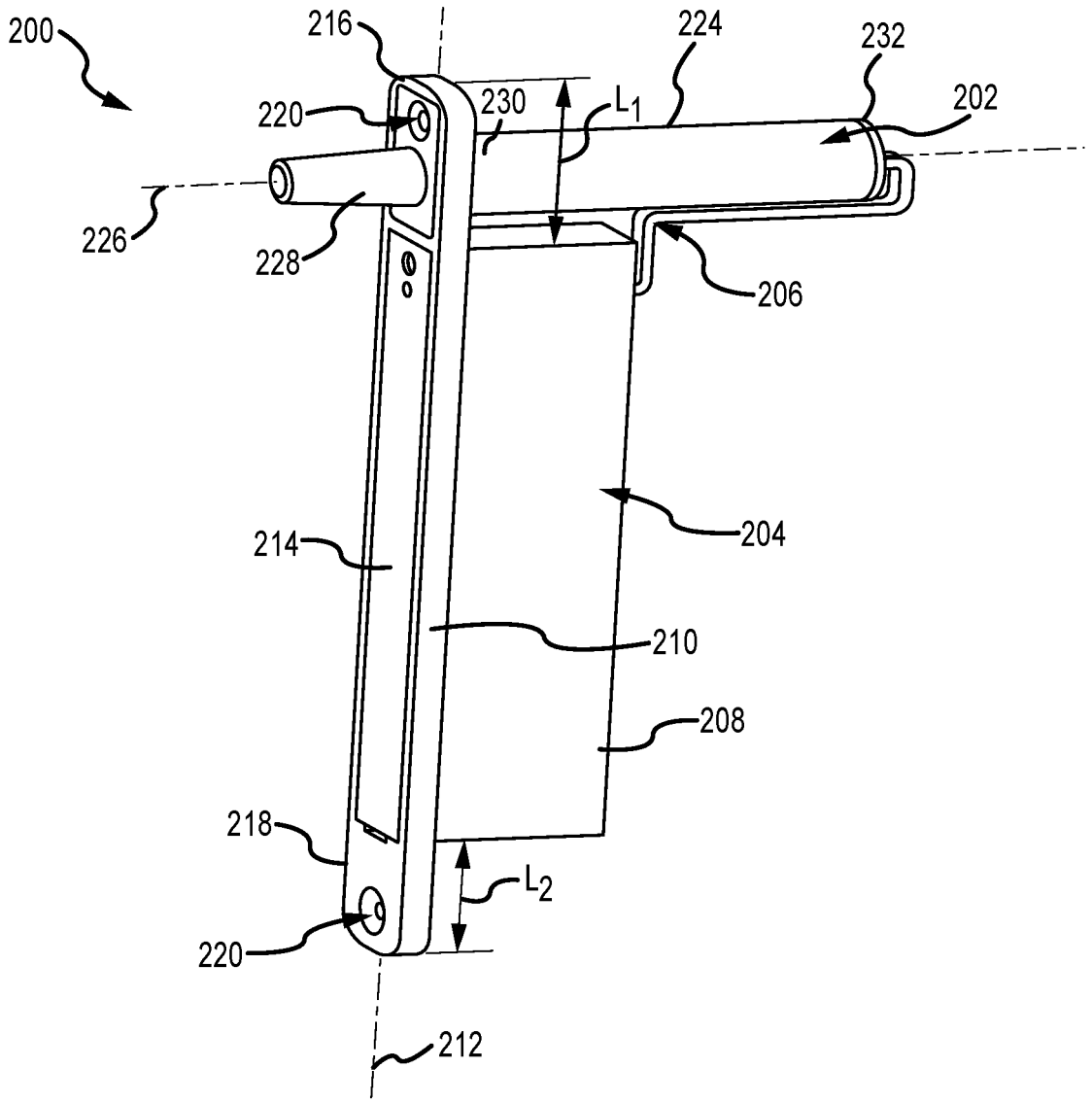
FIGS. 2A and 2B are perspective views of an exemplary modular electronic deadbolt.
Figure 2B:
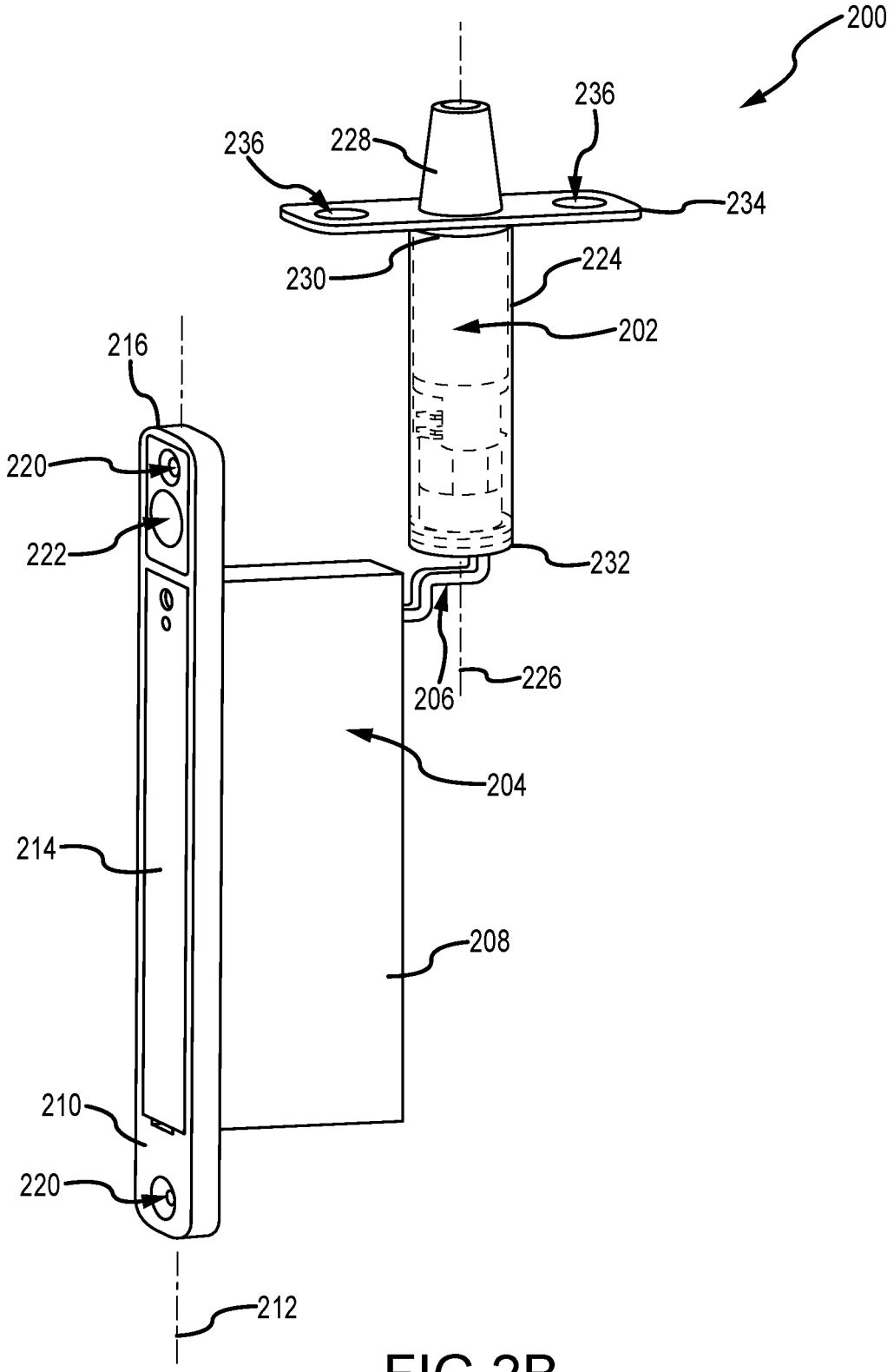

FIGS. 2A and 2B are perspective views of an exemplary modular electronic deadbolt 200 for use with the multi-point electric door lock system 100 (shown in FIG. 1). Referring concurrently to FIGS. 2A and 2B, the modular electronic deadbolt 200 includes a bolt module 202 and a battery module 204 that are configured to be operatively coupled to one another. In the example, the bolt module 202 and the battery module 204 are coupled in communication by a connecting cable 206. The connecting cable 206 enables power and communication between the modules 202, 204. In other examples, the bolt module 202 and the battery module 204 may be remotely coupled in communication, for example, by wireless communication systems and protocols.

The bolt module 202 is also configured to be removably physically coupled to the battery module 204. In FIG. 2A, for example, the modular electronic deadbolt 200 is illustrated in a first configuration and the bolt module 202 is physically coupled to the battery module 204, while in FIG. 2B, the modular electronic deadbolt 200 is illustrated in a second configuration and the bolt module 202 is positioned remote from the battery module 204. As such, the first configuration shown in FIG. 2A may be used to install the modular electronic deadbolt 200 along a locking edge of the door, and the second figuration shown in FIG. 2B may be used to install the bolt module 202 along a head or sill edge of the door and the battery module 204 along a locking edge of the door. By enabling separation of the bolt module 202 from the battery module 204 as required or desired, the modular electronic deadbolt 200 may be mounted on the door and/or door fame and facilitate various mounting positions as described above in reference to FIG. 1. Furthermore, the battery module 204 may always be configured to be mounted on the door or door frame to enable easy access into the battery module 204 to facilitate maintenance of the modular electronic deadbolt 200 and replacing the batteries therein. For example, in the second configuration shown in FIG. 2B, if the bolt module 202 is installed in the sill of the door, then the battery module 204 may be installed on the locking edge such that the batteries that power the system may be more easily accessible.

As illustrated by FIG. 2A, the modular electronic deadbolt 200 is in the first configuration such that the bolt module 202 may be coupled to the battery module 204 and mounted together on the door or door frame. For example, the modular electronic deadbolt 200 may be mounted to a locking edge of a pivoting door, and as such, enable easy access to the battery module 204 from the locking edge. In this example, the battery module 204 includes a battery housing 208 and a face plate 210 that extends along a longitudinal axis 212. The face plate 210 is configured to mount on the edge of the door or door frame and be recessed therein. The battery module 204 also includes a removable cover 214 that enables access into the battery housing 208. The face plate 210 includes a first extension 216 and a second extension 218, each extending along the longitudinal axis 212 and away from the battery housing 208. Each extension 216, 218 may also define an aperture 220 that is configured to receive a fastener and secure the battery module 204 to the door or door frame. In some examples, the apertures 220 may be countersunk to enable receipt of a flat head screw.

One or both of the extensions 216, 218 may be configured to removably receive a portion of the bolt module 202 and enable the bolt module 202 to be coupled to the battery module 204. In the example, the extension 216 includes an opening 222 (shown in FIG. 2B) that is sized and shaped to receive at least a portion of the bolt module 202 so that the bolt module 202 may engage with the extension 216. For example, the bolt module 202 may frictionally couple to the extension 216 so as to secure it in place. In some examples, the bolt module 202 may be connected to the extension 216 through a threaded-type connection. In alternative examples, the bolt module 202 may be connected to the extensions 216, 218 through any other type of connection that enables the modular electronic deadbolt 200 to function as described herein. In the first configuration, the bolt module 202 is positioned at a top end of the face plate 210 (e.g., the first extension 216) such that the battery housing 208 is accessible from the face plate 210 via the cover 214. As such, the first extension 216 may have a longer length $L_1$ than a length $L_2$ of the second extension 218. In other examples, each length $L_1$ and $L_2$ may be approximately equal. In alternative examples, the bolt module 202 can be positioned at the bottom end of the face plate 210 (e.g., the second extension 218), along sides of the face plate 210 and offset of the longitudinal axis 212, via a mounting bracket (not shown), or any other position that enables access to the battery housing 208 as described herein.

In the example, the bolt module 202 includes a bolt housing 224 defining a longitudinal axis 226 and a deadbolt 228 configured to be linearly moveable in relation to the bolt housing 224 along the longitudinal axis 226. The housing 224 includes a first end 230 and an opposite second end 232 extending along the longitudinal axis 226. The first end 230 may be configured to couple to the battery module 204 as described herein. Additionally, the deadbolt 228 is disposed at the first end 230 so that it may extend and retract along the longitudinal axis 226. The second end 232 may be configured to receive the connecting cable 206. In the first configuration, the bolt module 202 is coupled to the battery module 204 such that the longitudinal axis 212 of the face plate 210 is substantially orthogonal to the longitudinal axis 226 of the bolt housing 224. Additionally, when the first end 230 of the bolt housing 224 is coupled to the extension 216, the deadbolt 228 is configured to extend and retract in relation to the face plate 210. In other examples, the bolt module 202 may include hook-shaped deadbolts that rotate out of the bolt housing 224 and enable sliding doors to be locked from the locking edge of the door.

Turning now to FIG. 2B, the modular electronic deadbolt 200 is in the second configuration such that the bolt module 202 is remotely disposed from the battery module 204 and can be mounted at a separate location on the door and/or the door frame. For example, the bolt module 202 may be mounted to a head or sill of the door, while the battery module 204 may be mounted to a locking edge of the door. In this second configuration, the longitudinal axis 212 of the face plate 210 is substantially parallel to the longitudinal axis 226 of the bolt housing 224. As such, the battery module 204 may still be easily accessible from the locking edge of the door even with the deadbolt 228 extendable from the head and/or the sill. In alternative examples, the bolt module 202 may be oriented in any other configuration in relation to the battery module 204 as required or desired.

In the example, when the bolt module 202 is disposed remote from the battery module 204, a mounting plate 234 may be coupled to the first end 230 of the bolt housing 224 to facilitate mounting the bolt module 202 to the door or door frame. The mounting plate 234 may include one or more apertures 236 to facilitate mounting the bolt module 202 to the door or door frame. The modular electronic deadbolt 200 allows the same bolt module 202 and battery module 204 to be used in multiple door and door frame locations without having to change out or switch any components. As such, the modules 202, 204 are versatile and can be configured to be used in a variety of applications and in any location of the door and/or door frames. In some examples, the connecting cable 206 may be shortened and/or lengthened depending on the location of the bolt module 202 in relation to the battery module 204. In other examples, the bolt module 202 and the battery module 204 may be wireless such that the two modules may be positioned anywhere on the door relative to one another, or the modules may be split between the door and the door frame. In further examples, a single battery module 204 may operably connect to more than one bolt module 202.

Figure 3:
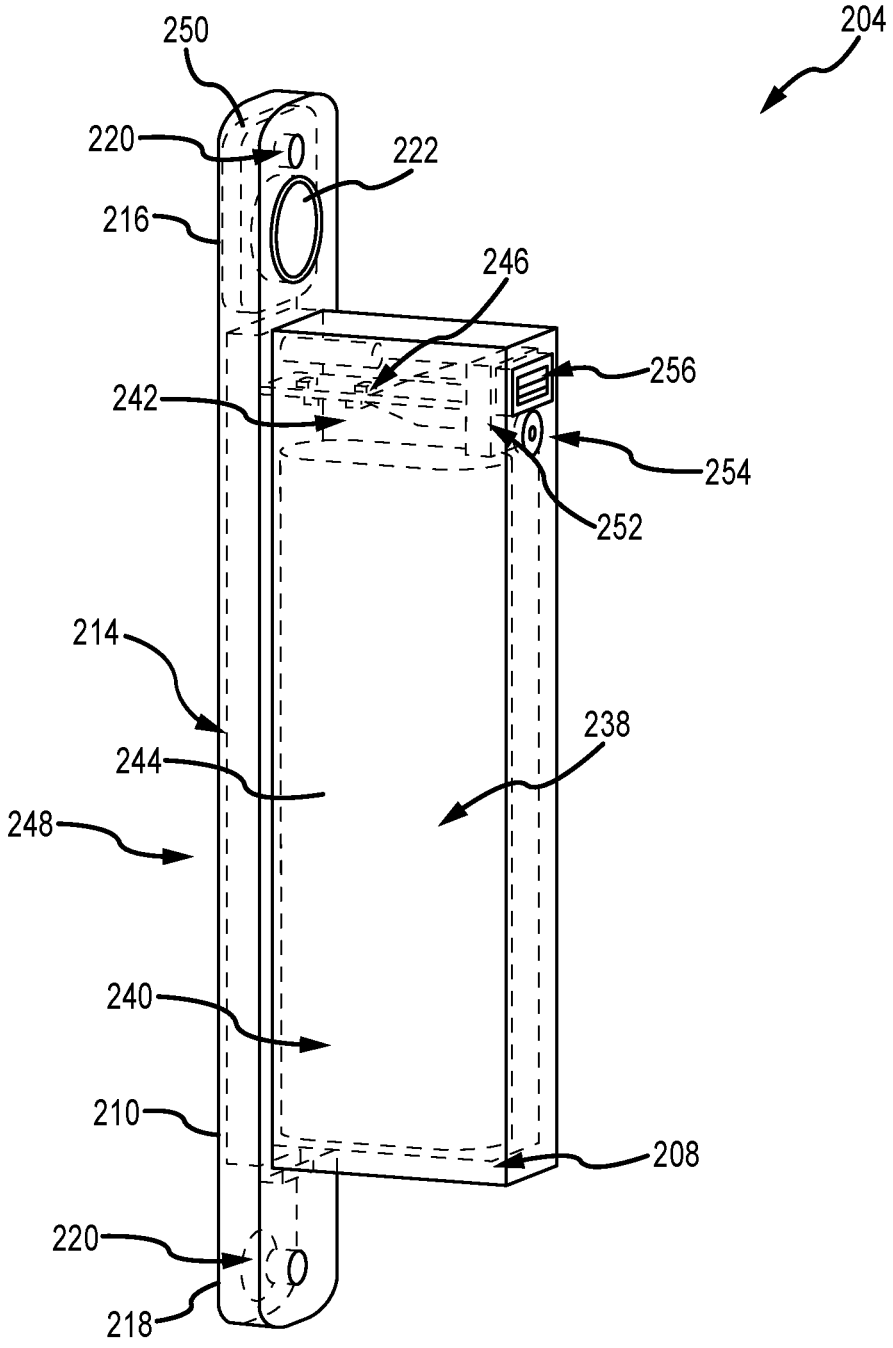
FIG. 3 is an interior perspective view of a battery module shown in FIGS. 2A and 2B.

FIG. 3 is an interior perspective view of the battery module 204. Certain components are described above, and as such, may not be described further. The battery housing 208 is illustrated as transparent so as to show the components contained therein. The battery housing 208 defines a chamber 238 that may include a battery portion 240 and a circuit board portion 242. The battery portion 240 and the circuit board portion 242 may be separated into separate chambers, if required or desired. A battery carrier 244 acting as a power source is removably disposed in the battery portion 240 and includes a plurality of battery contacts (not shown). In the example, the battery carrier 244 is sized and shaped to receive four "AA" batteries, although other battery types, arrangements, and power sources may be utilized. In other examples, the battery carrier 244 may be integral within the battery portion 240 with the battery contacts extending from the interior of the housing walls. The battery carrier 244 is configured to be in electrical communication with a circuit board 246 that is disposed in the circuit board portion 242 such that electrical power is provided thereto.

The entire chamber 238 is accessible through a front slot 248 defined in the face plate 210 that has the removable cover 214. In other examples, the circuit board portion 242 may not be directly accessible through the cover 214.

The first extension 216 of the face plate 210 includes the opening 222 sized and shaped to receive the bolt module 202 when the modular electronic deadbolt is disposed in the first configuration shown in FIG. 2A. A cover plate 250 may be included for attaching to the face plate 210 and covering the opening 222 when the bolt module 202 is not coupled to the battery module 204 in the first configuration. The aperture 220 defined in the face plate 210 may receive fasteners, e.g., screws (not shown), to enable the battery module 204 to be secured on a door or door frame. The circuit board 246 is disposed within the circuit board portion 242 and supported by a chassis 252 secured within the chamber 238 by a mounting fastener 254. The circuit board 246 includes one or more connector interfaces 256 configured to receive the connecting cable that communicatively couples the bolt module 202 to the battery module 204. One or more connector interfaces 256 may extend from the circuit board 246 and out of the back of the battery housing 208 such that the bolt module 202 may be coupled in communication to the battery module 204 via the connector cable. Furthermore, the circuit board 246 is configured to communicate wirelessly with the keeper sensor and/or remote panel and smartphone as described above in reference to FIG. 1 to receive signals and extend/retract the deadbolt of the bolt module as required or desired. The circuit board 246 may include any component that is configured to provide control and operation, including any wireless components to enable wireless operation, of the bolt module 202 as described herein.

Figure 4:
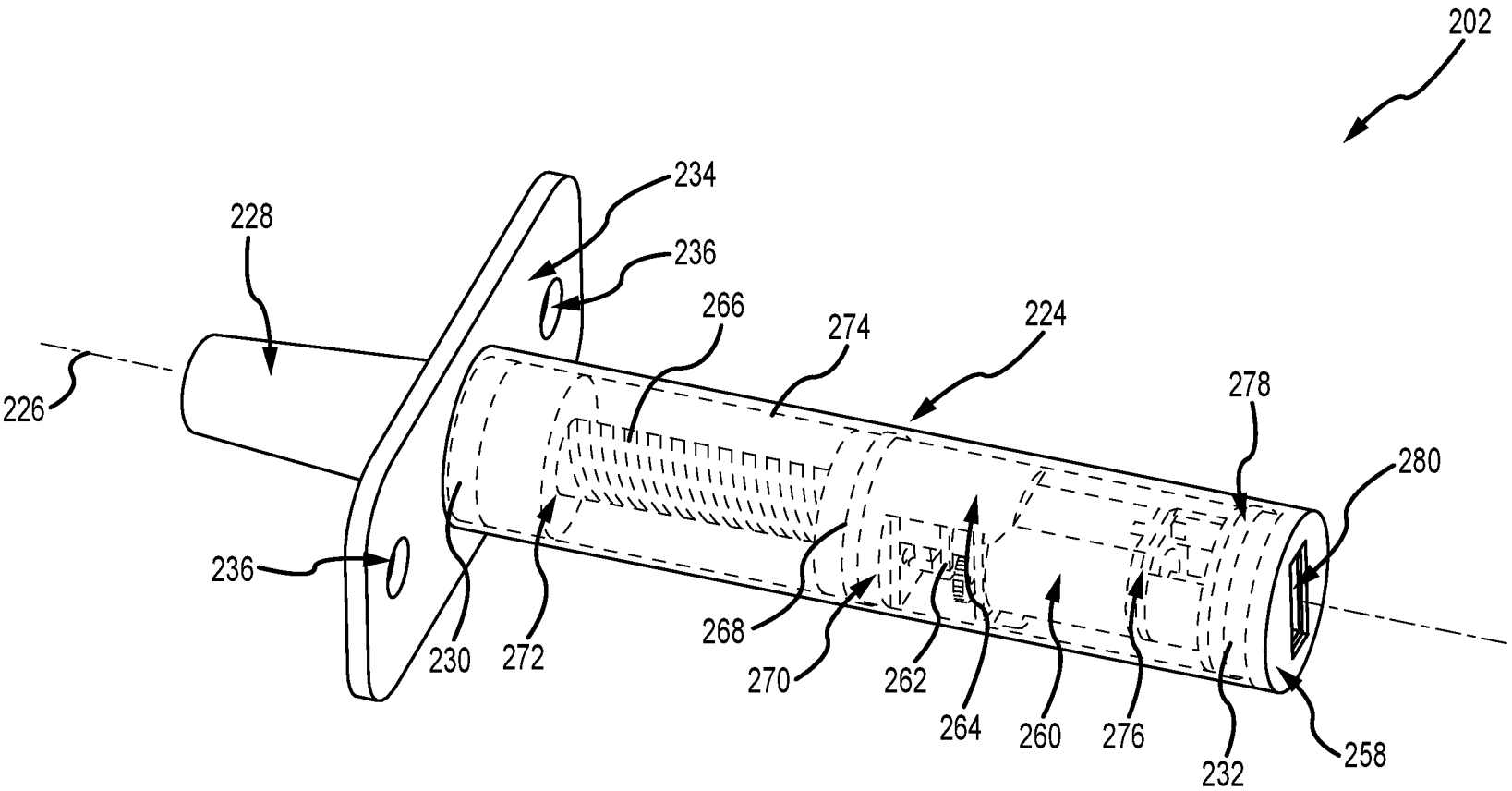
FIG. 4 is an interior perspective view of a bolt module shown in FIGS. 2A and 2B.

FIG. 4 is an internal perspective view of the bolt module 202. Certain components are described above, and as such, may not be described further. The bolt housing 224 is illustrated as transparent so as to show the components contained therein. At the first end 230 of the bolt housing 224, the bolt module 202 includes the mounting plate 234 that defines the apertures 236 that are configured to receive a fastener for mounting the bolt module 202 to a door or a door frame. In the example, the mounting plate 234 may be removable so that the housing 224 may couple to the battery module. In other examples, the mounting plate 234 may remain coupled to the bolt housing 224 so that it is received by the face plate of the battery module and aligns with the extension. This alternative configuration is described further below in reference to FIGS. 5A-6C.

At the second end 232 of the bolt housing 224, an end cap 258 is included to enclose the bolt components within the housing 224. Within the bolt housing 224, the bolt module 202 includes a motor 260 that is configured to rotatably drive a motor shaft (not shown). The motor 260 may be an off-the-shelf unit that includes an integral gear set 262 supported by a chassis 264. In other examples, any other drive system may be used that enables the bolt module to function as described herein. The drive shaft of the motor 260 is coupled to a leadscrew 266 such that upon operation of the motor 260 the leadscrew 266 may rotate along the longitudinal axis 226 of the bolt module 202. Between the leadscrew 266 and the gear set 262, the bolt module 202 may also include an O-ring 268 and/or a gasket 270 to secure the motor 260 within the bolt housing 224. The leadscrew 266 is engaged with a nut 272 that connects the leadscrew 266 to the deadbolt 228, such that rotation of the leadscrew 266 translates into linear movement of the nut 272 and thereby the deadbolt 228. In the example, the deadbolt 228 engages with one or more fixed guides 274 that extend along the longitudinal axis 226 adjacent to the leadscrew 266. For example, the deadbolt 228 has one or more projections that are received at least partially within a corresponding channel of the guide 274. The guides 274 prevent rotation of the nut 272 so that the leadscrew 266 can extend and retract the deadbolt 228 from the bolt housing 224.

The motor 260 is coupled to a circuit board 276 adjacent to the end cap 258. The end cap 258 may be secured to the bolt housing 224 by an O-ring 278. The circuit board 276 includes a connector interface 280 such that the connecting cable may be received within the bolt module 202 and be coupled to the circuit board 276. The circuit board 276 may include any component that is configured to provide control and operation, including any wireless components to enable wireless operation, of the bolt module 202 as described herein.

The bolt module 202 is arranged and configured in a manner that reduces overall space, eases installation (even by untrained purchasers), for example, through use of a standard size drill bit, and limits end-user access to the internal components. To reduce space, the elongate elements of the bolt module 202 are configured so as to have parallel axes (e.g., rotational axes). For example, the deadbolt 228, the leadscrew 266, the motor 260, and the circuit board 276 are all axially aligned along the longitudinal axis 226. By axially arranging these elongate elements, the circumference of the bolt housing 224 may be reduced, which eases installation because a standard size drill bit may be used to bore out the installation cavity. Further, by positioning the motor 260 and the circuit board 276 behind the deadbolt 228, access to the drive and control components are more difficult to access when mounted on a door or door frame.

Figure 5A:
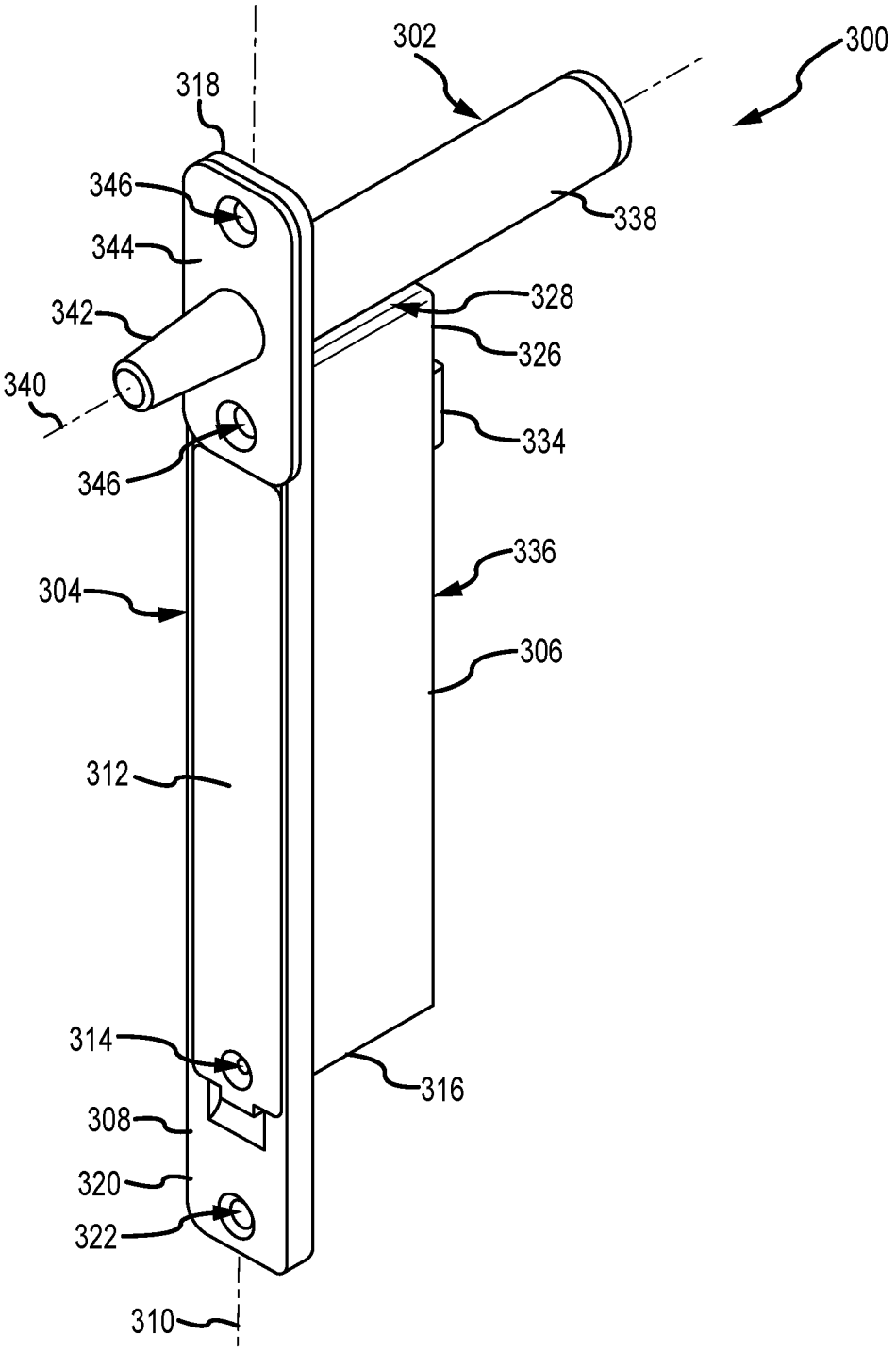
FIG. 5A is a perspective view of another modular electronic deadbolt in a first configuration.
Figure 5B:
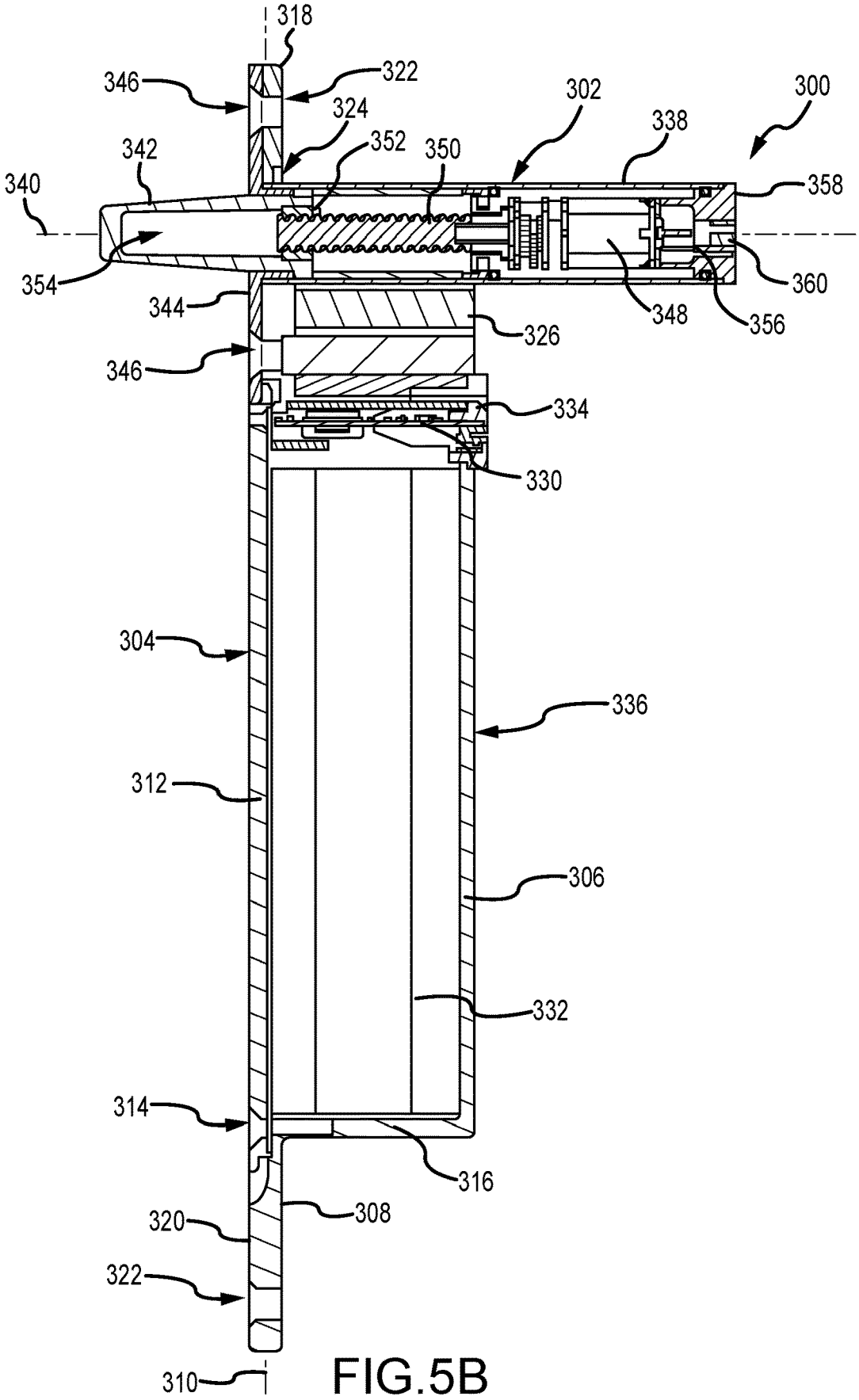
FIG. 5B is a cross-sectional view of the modular electronic deadbolt shown in FIG. 5A.

FIG. 5A is a perspective view of another modular electronic deadbolt 300 in a first configuration. FIG. 5B is a cross-sectional view of the modular electronic deadbolt 300 in the first configuration. Referring concurrently to FIGS. 5A and 5B, the modular electronic deadbolt 300 includes a bolt module 302 that is configured to be removably coupled to a battery module 304 as described above. In the example, the bolt module 302 may be coupled in communication by a connecting cable (not shown) or by wireless components. Additionally, both the bolt module 302 and the battery module 304 have similar internal components as described in detail above.

The battery module 304 includes a battery housing 306 and a face plate 308 that extends along a longitudinal axis 310. A removable cover 312 enables access into the battery housing 306 from the face plate 308. In some examples, the cover 312 may include an aperture 314 that enables a fastener (not shown) to be secured into a bottom wall 316 of the battery housing 306. The face plate 308 includes a first extension 318 and a second extension 320, each extending along the longitudinal axis 310 and away from the battery housing 306. Each extension 318, 320 may also define an aperture 322 that is configured to receive a fastener and secure the battery module 304 to the door or door frame. One or both of the extensions 318, 320 may be configured to removably receive a portion of the bolt module 302 to couple the bolt module 302 to the battery module 304. In the example, the extension 318 includes an opening 324 in which at least a portion of the bolt module 302 extends through for the bolt module 302 to be coupled to the battery module 304 in the first configuration.

In this example, the battery housing 306 includes a spacer 326 that is positioned adjacent to the opening 324 and is configured to support the bolt module 302. The spacer 326 enables at least a portion of the bolt module 302 to be supported while in the first configuration. That is, the spacer 326 includes a top mounting surface 328 that abuts the bolt module 302 when the modular electronic deadbolt 300 is in the first configuration. The spacer 326 may be integral with the battery housing 306 and disposed above a circuit board 330 and opposite of a battery carrier 332. In other examples, the spacer 326 may be a removable component that is selectively coupled to the battery housing 306 for the first configuration. A connector interface 334 of the circuit board 330 may be disposed on a back wall 336 of the battery housing 306 and enable the battery housing 304 to be coupled in communication to the bolt module 302 (e.g., via a connector cable). The circuit board 330 is also configured to be in remote communication with an electronic keeper so as to receive a signal and extend/retract the bolt module 302 as described above.

The bolt module 302 includes a bolt housing 338 defining a longitudinal axis 340, a deadbolt 342, and a mounting plate 344. When the bolt module 302 is in the first configuration, the mounting plate 344 aligns with the first extension 318. More specifically, the mounting plate 344 may be at least partially recessed within the face plate 308 so that it is flush with the cover 312. The mounting plate 344 includes one or more apertures 346 that facilitate securing the bolt module 302 to the battery module 304 in the first configuration and to mount the bolt module 302 to a door or door frame when in the second configuration (shown in FIGS. 5C and 5D). For example, in the first configuration one aperture 346 of the mounting plate 344 can align with the aperture 322 of the first extension 318 so that the mounting plate 344 can be coupled to the face plate 308 and both can be mounted on a door or a door frame. The other aperture 346 of the mounting plate 344 may be used so that a fastener (not shown) may be received within the spacer 326 of the battery housing 306 and the bolt module 302 is coupled to the battery module 304. In alternative examples, the bolt module 302 and the mounting plate 344 may be mounted on the back side of the face plate 308 (e.g., the side towards the battery housing 306) such that the deadbolt 342 can extend and retract out of the opening 324 of the extension 318.

Within the bolt housing 338, the bolt module 302 includes a motor 348 that is configured to rotatably drive a leadscrew 350. The leadscrew 350 extends along the longitudinal axis 340 and is threadably engaged with the deadbolt 342 via a nut 352. The deadbolt 342 includes an interior channel 354 such that when the deadbolt 342 is retracted within the bolt housing 338 (FIG. 5B illustrates the deadbolt in an extended position), the leadscrew 350 extends into the interior channel 354. The motor 348 is coupled to a circuit board 356 and enclosed within the bolt housing 338 by an end cap 358. A connector interface 360 of the circuit board 330 may be disposed on end cap 358.

In this example, the face plate 308 is larger to accommodate the mounting plate 344 of the bolt module 302, when the bolt module 302 is mounted orthogonally with the battery module 304 and illustrated in FIG. 5A. As such, the bolt module 302 is not required to be modified for any required or desired configuration of the modular electronic deadbolt 300. Additionally, the spacer 326 extends from the top of the battery housing 306 to support the bolt module 302.

Figure 5C:
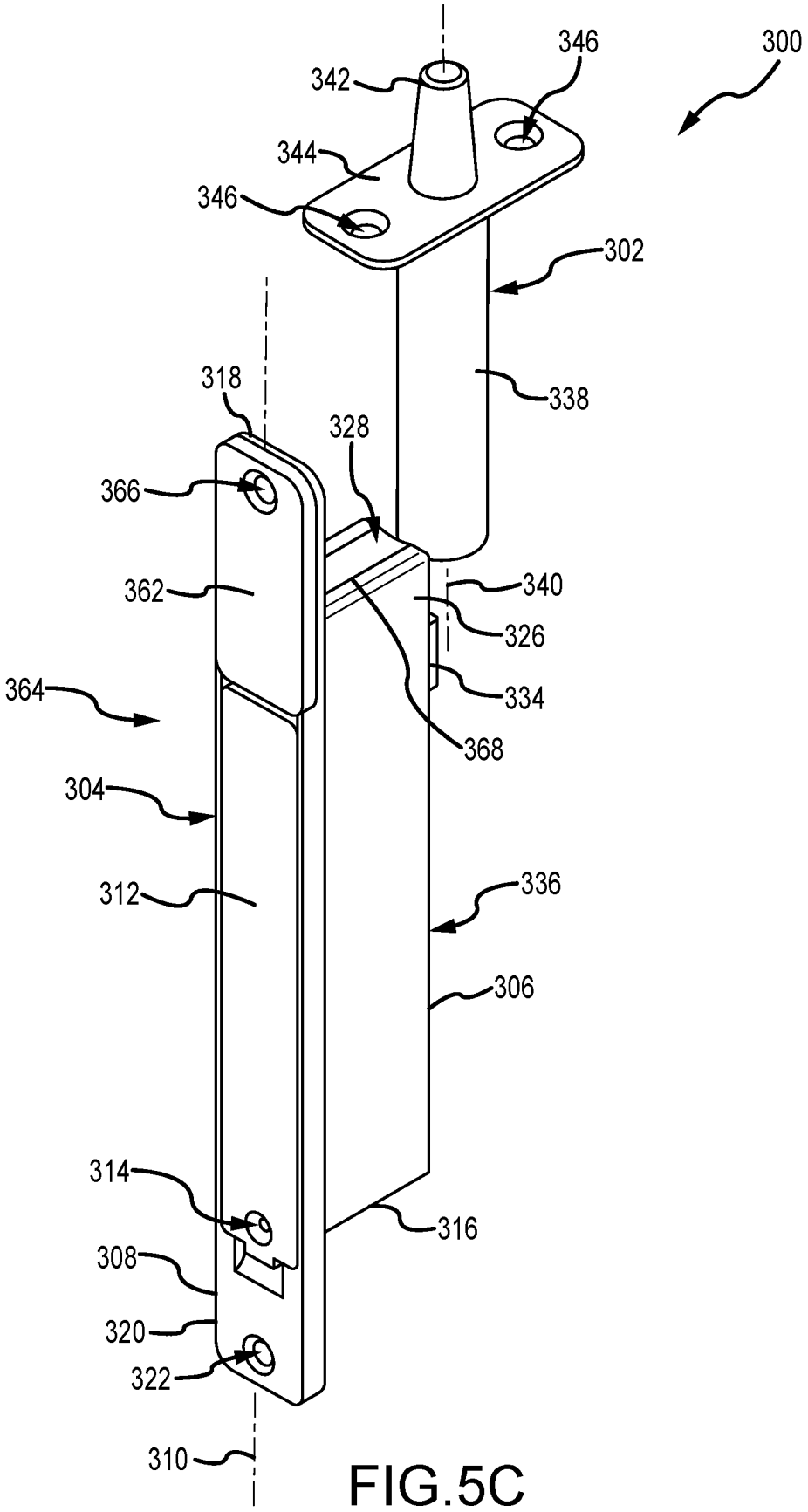
FIG. 5C is a perspective view of the modular electronic deadbolt in a second configuration.
Figure 5D:
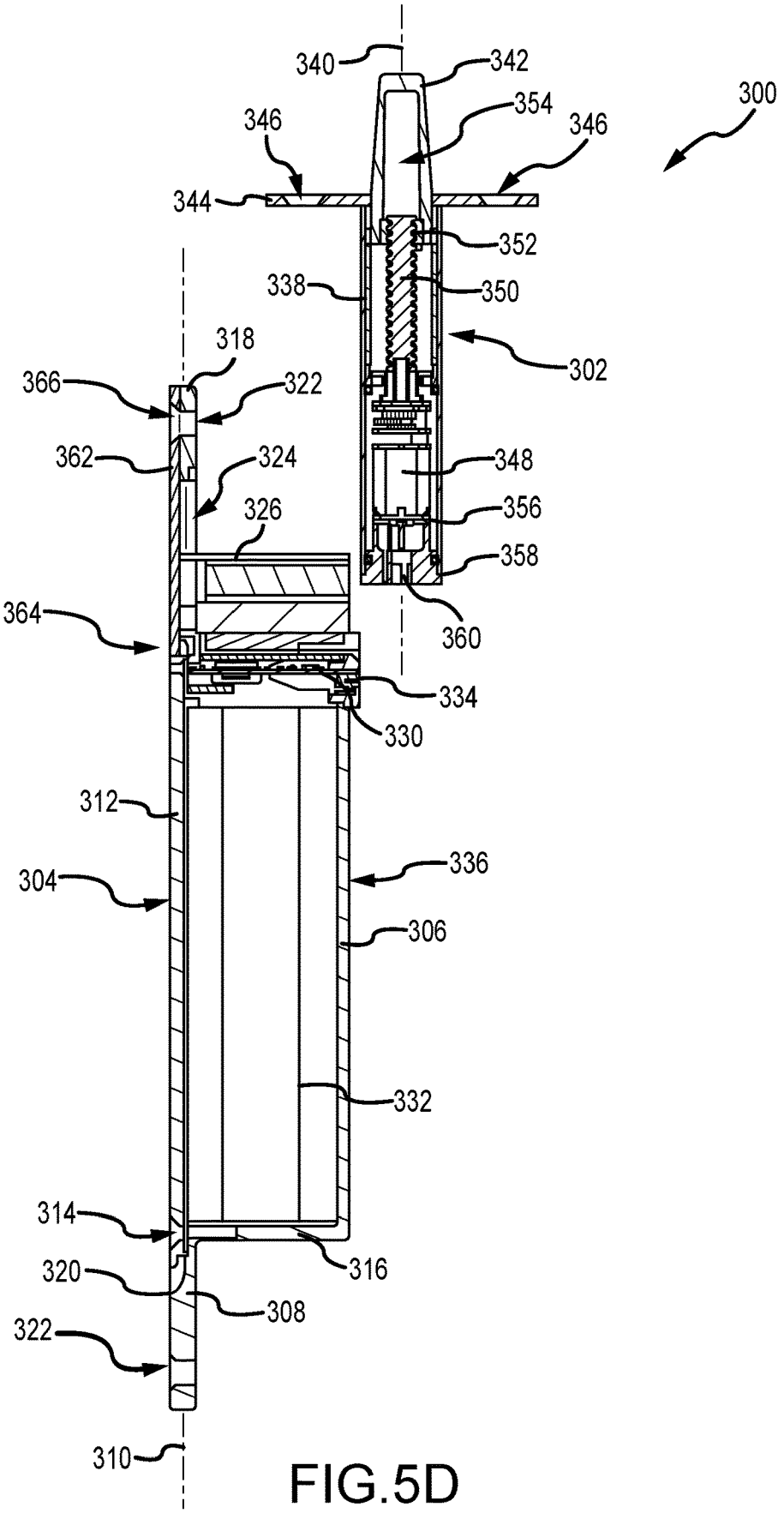
FIG. 5D is a cross-sectional view of the modular electronic deadbolt shown in FIG. 5C.

FIG. 5C is a perspective view of the modular electronic deadbolt 300 in a second configuration. FIG. 5D is a cross-sectional view of the modular electronic deadbolt 300 in the second configuration. Referring concurrently to FIGS. 5C and 5D, certain components are described above, and as such, may not be described further. In the second configuration of the modular electronic deadbolt 300, the bolt module 302 is remotely disposed from the battery module 304 and in any orientation as required or desired. As illustrated, for example, the bolt module 302 can be oriented along the longitudinal axis 340 that is substantially parallel to the longitudinal axis 310 of the battery module 304.

When the bolt module 302 is remote from the battery module 304, a cover plate 362 may couple to the face plate 308 and within the recess formed for the mounting plate 344 such that a front 364 of the battery module 304 (e.g., the face plate 308, the cover 312, and the cover plate 362) form a substantially flat surface. The cover plate 362 may include an aperture 366 that can align with the aperture 322 of the first extension 318 so that the cover plate 362 can be coupled to the face plate 308 and both can be mounted on a door or a door frame. A portion of the cover plate 362 may also extend at least partially through the opening 324 (shown in FIG. 5B) that receives the bolt module 302 in the first configuration. Additionally, the top mounting surface 328 may include a curved portion 368 that corresponds in shape to the bolt housing 338 of the bolt module 302, allowing for close contact therebetween.

Figure 6A:
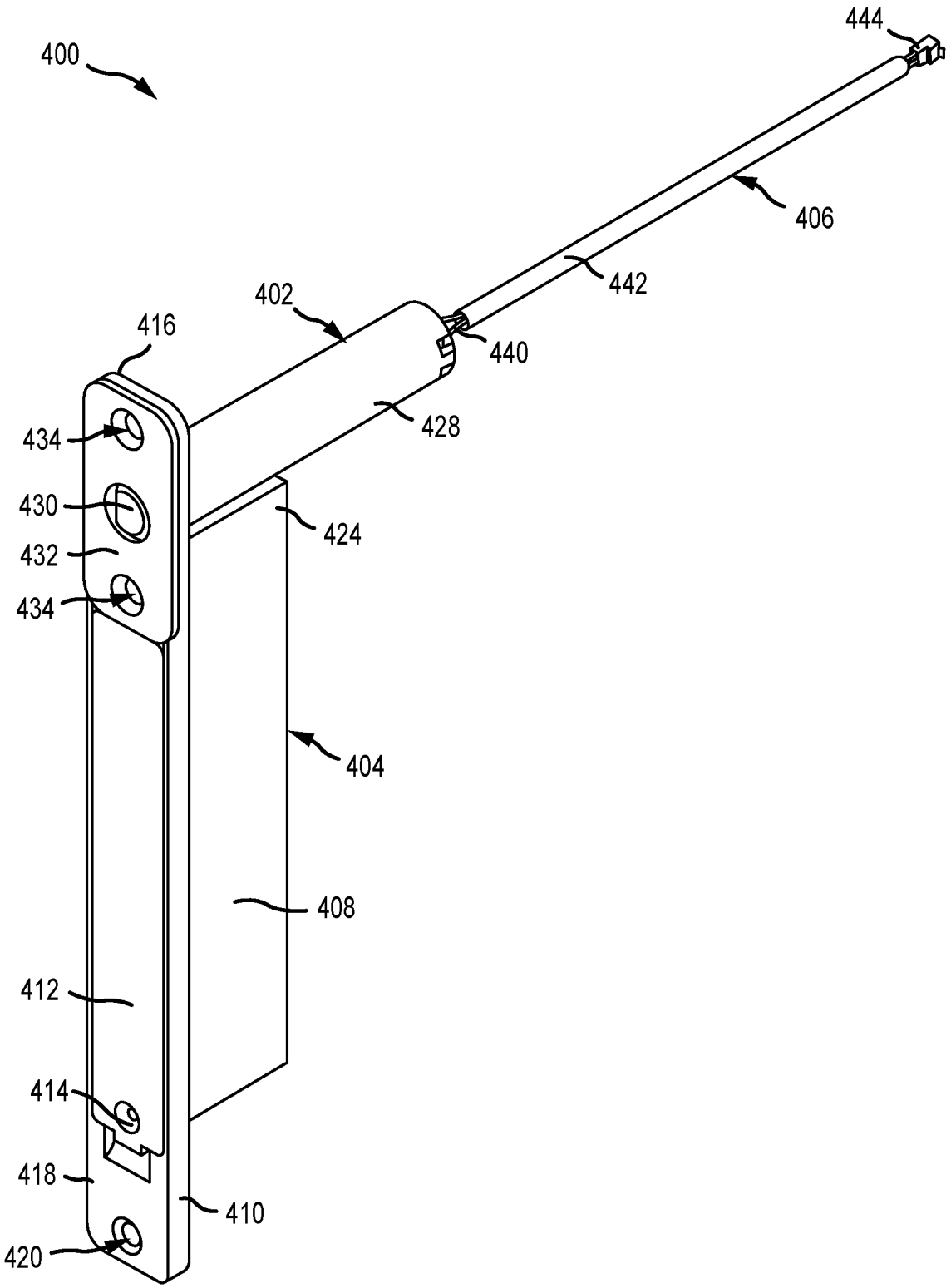
FIG. 6A is a perspective view of another modular electronic deadbolt in a first configuration.
Figure 6B:
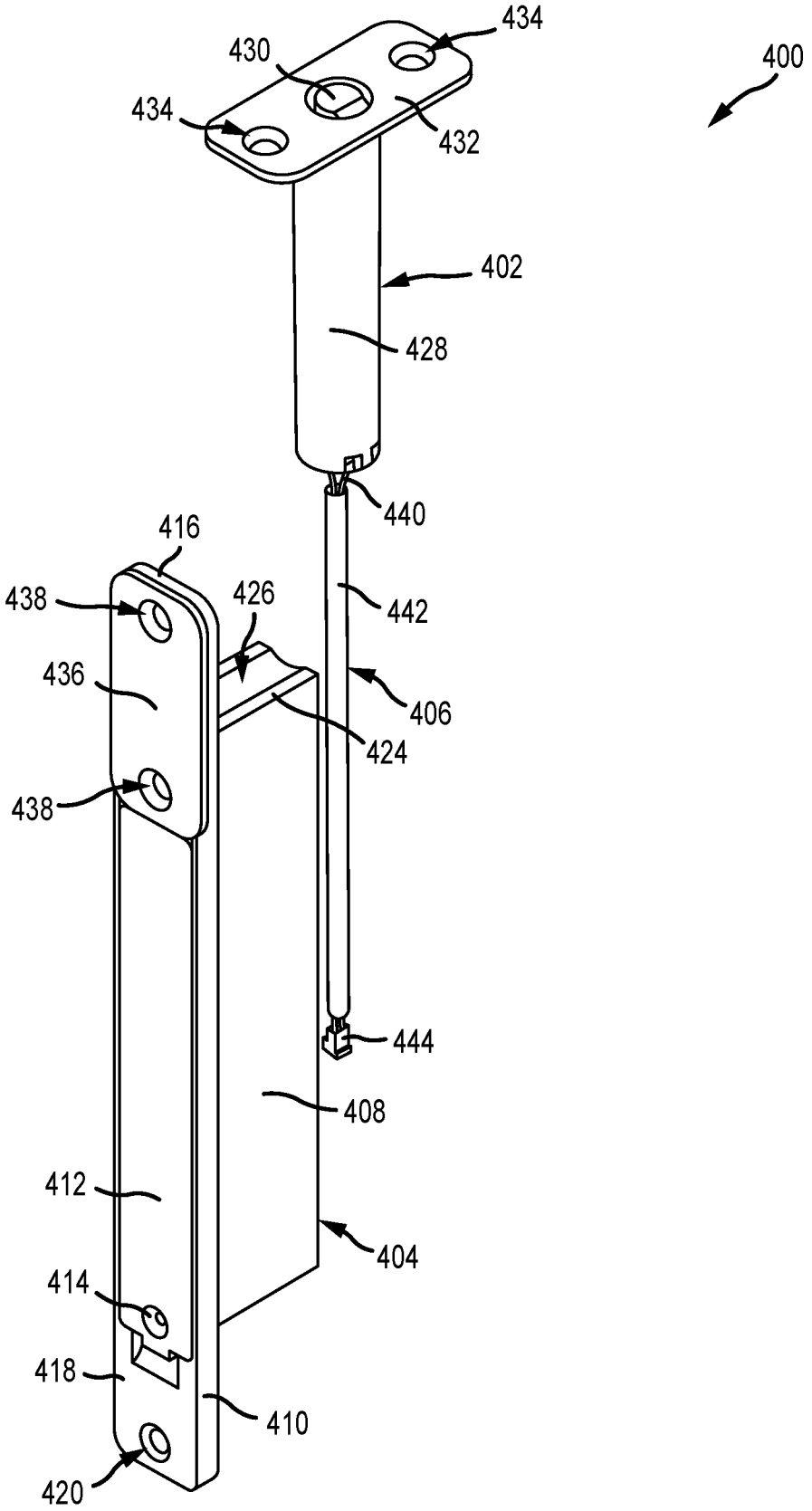
FIG. 6B is a perspective view of the modular electronic deadbolt in a second configuration.

FIG. 6A is a perspective view of another modular electronic deadbolt 400 in a first configuration. FIG. 6B is a perspective view of the modular electronic deadbolt 400 in a second configuration. Referring concurrently to FIGS. 6A and 6B, the modular electronic deadbolt 400 includes a bolt module 402 that is configured to be removable coupled to a battery module 404 as described above. In the example, the bolt module 402 may be coupled in communication by a connecting cable 406, which is depicted as disconnected in FIGS. 6A and 6B. Additionally, both the bolt module 402 and the battery module 404 have similar internal components as described in detail above.

The battery module 404 includes a battery housing 408 and a face plate 410. A removable cover 412 enables access into the battery housing 408 from the face plate 410. In some examples, the cover 412 may be secured to the battery module 404 by a fastener 414 that extends into the battery housing 408. The face plate 410 includes a first extension 416 and a second extension 418, each including an aperture 420 that is configured to receive a fastener and secure the battery module 404 to the door or door frame. One or both of the extensions 416, 418 may be configured to removably receive a portion of the bolt module 402 to couple the bolt module 402 to the battery module 404. In the example, the extension 416 includes an opening 422 (shown in FIG. 6C) that is sized and shaped to receive at least a portion of the bolt module 402. In this example, the battery housing 408 includes a spacer 424 that extends at least partially along the first extension 416 so as to enable at least a portion of the bolt module 402 to be supported while in the first configuration. A top mounting surface 426 may correspond to the shape of the bolt module 402.

The bolt module 402 includes a bolt housing 428, a deadbolt 430, and a mounting plate 432. In the example, the deadbolt 430 is illustrated in its retracted position and disposed within the bolt housing 428. When the bolt module 402 is in the first configuration, the mounting plate 432 aligns with the first extension 416. The mounting plate 432 includes one or more apertures 434 that facilitate securing the bolt module 402 to the battery module 404 in the first configuration and to mount the bolt module 402 to a door or door frame when in the second configuration. When the bolt module 402 is remote from the battery module 404 (e.g. the second configuration), a cover plate 436 may couple to the face plate 410 at the first extension 416. The cover plate 436 may include one or more apertures 438. One aperture 438 of the cover plate 436 can align with the aperture 420 of the first extension 416 so that the cover plate 436 can be coupled to the face plate 410 and both can be mounted on a door or a door frame. The other aperture 438 of the cover plate 436 may be used so that a fastener (not shown) may be received within the spacer 424 of the battery housing 408.

The connecting cable 406 may include two electrical wires 440 (e.g., positive and negative) that extend from the bolt housing 428 and are wrapped in a protective sheathing 442. At the free end of the wires 440, a connector plug 444 is included so that the connecting cable 406 can be plugged into the battery module 404. In other examples, the wire 400 may include plugs at either end such that a length L (shown in FIG. 6C) of the connecting cable 406 can be adjusted as required or desired.

Figure 6C:
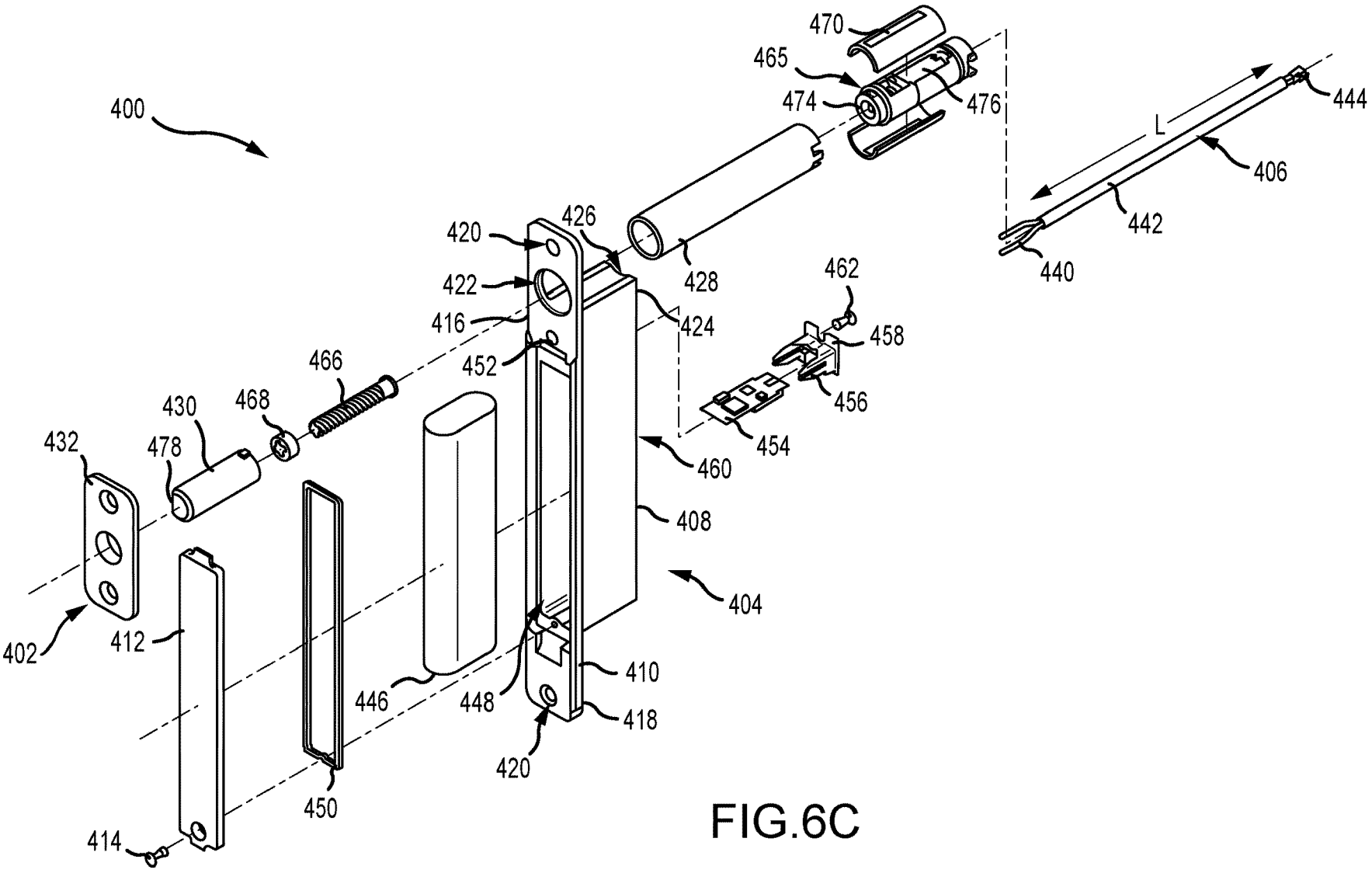
FIG. 6C is an exploded perspective view of the modular electronic deadbolt shown in FIGS. 6A and 6B.

FIG. 6C is an exploded perspective view of the modular electronic deadbolt 400. Certain components are described above, and as such, may not be described further. In the example, the battery housing 408 and the face plate 410 of the battery module 404 may be formed as a unitary component. The battery housing 408 is configured to receive and house a removable battery carrier 446 through an elongated front slot 448 defined in the face plate 410. The cover 412 is shaped and sized to cover the front slot 448 so that the battery carrier 446 is secured within the battery module 404. An O-ring 450 may be used to reduce dirt, debris, and moisture entry into the battery module 404.

The first extension 416 may be at least partially recessed with respect to the other portions of the face plate 410 so that the mounting plate 432 or cover plate 436 (shown in FIG. 6B) can be secured flush onto the face plate 410. The first extension 416 defines an aperture 452 that extends into the spacer 424 so that the mounting plate or cover plate can be secured to the face plate 410 with a corresponding fastener (not shown). Additionally, at least a portion of the top mounting surface 426 may correspond in shape to the opening 422 that is configured to receive the bolt module 402. For example, a curved surface portion corresponds in curvature to the opening 422. Additionally, the battery module 404 includes a circuit board 454 that is supported within the battery housing 408 by a chassis 456. In this example, the chassis 456 may also include a connection interface 458 that is configured to receive the connector plug 444 of the connecting cable 406. The connection interface 458 may mount flush along a back wall 460 of the battery housing 408. A fastener 462 may be used to secure the chassis 456 to the back wall 460.

The bolt module 402 includes a substantially cylindrical bolt housing 428 that is configured to house a motor assembly 465, a leadscrew 466, a nut 468, a guide 470, and the deadbolt 430. The motor assembly 465 may include a mount 474 that supports the assembly within the bolt housing 428. A motor 476 drives rotation of a shaft (not shown) which is coupled to the leadscrew 466. In the example, the motor 476 is coupled directly to the battery module 404 via the wires 440 of the connecting cable 406 such that operation control is provided. In other examples, a circuit board (not shown) may be included within the bolt module 402 that provides control to the motor 476 and is coupled to the wires 440 of the connecting cable 406. The guide 470 surrounds at least a portion of the leadscrew 466 and engages with the deadbolt 430 to transfer rotational movement of the leadscrew 466 to linear movement of the deadbolt 430. The free end of the deadbolt 430 may include a taper 478.

Figure 7:
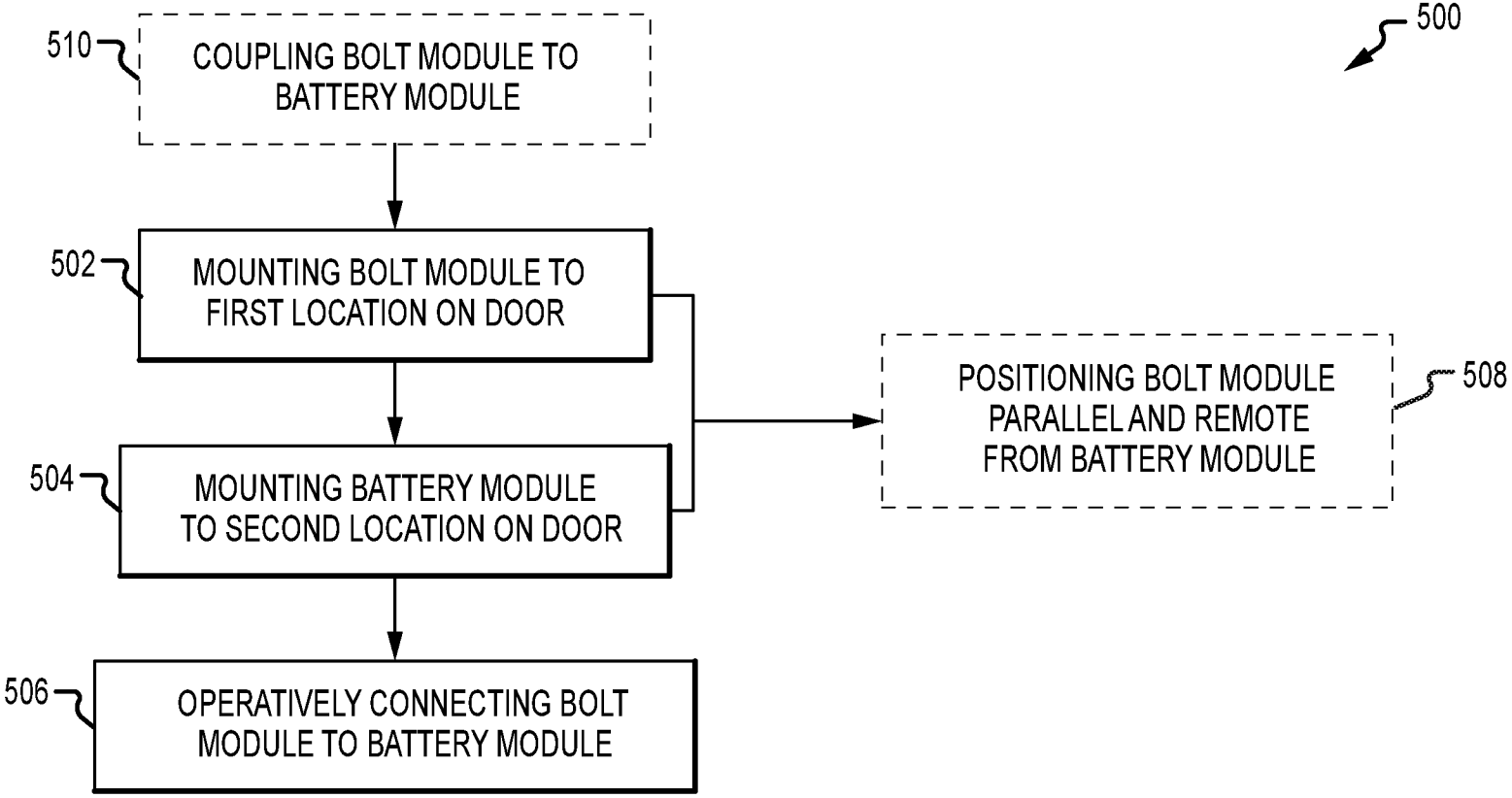
FIG. 7 is a flowchart illustrating an exemplary method of installing a modular electronic deadbolt.

FIG. 7 is a flowchart illustrating an exemplary method 500 of installing a modular electronic deadbolt onto a door. In this example, the method 500 may include mounting a bolt module to a first location on the door (operation 502). The bolt module may include a deadbolt linearly moveable along a first longitudinal axis by a motor and a leadscrew. A battery module is mounted to a second location on the door (operation 504). The battery module may include a faceplate that defines a second longitudinal axis. The bolt module is then operatively connected to the battery module (operation 506).

In some examples, the first location of the bolt module may be associated with a first edge of the door and the second location of the battery module may be associated with a second edge of the door that is different than the first edge. As such, when mounting the bolt module and the battery module to the door, the method 500 further includes positioning the first longitudinal axis substantially parallel to the second longitudinal axis and the bolt module remote from the battery module (operation 508). In another example, before mounting the bolt module and the battery module to the door, the method 500 includes coupling the bolt module to the battery module such that the first location of the bolt module is adjacent to the second location of the battery module and both locations are associated with a same edge of the door (operation 510). As such, the first longitudinal axis is substantially orthogonal to the second longitudinal axis.

The materials utilized in the manufacture of the lock described herein may be those typically utilized for lock manufacture, e.g., zinc, steel, aluminum, brass, stainless steel, etc. Molded plastics, such as PVC, polyethylene, etc., may be utilized for the various components. Material selection for most of the components may be based on the proposed use of the locking system. Appropriate materials may be selected for mounting systems used on particularly heavy panels, as well as on hinges subject to certain environmental conditions (e.g., moisture, corrosive atmospheres, etc.).

Any number of the features of the different examples described herein may be combined into one single example and alternate examples having fewer than or more than all of the features herein described are possible. It is to be understood that terminology employed herein is used for the purpose of describing particular examples only and is not intended to be limiting. It must be noted that, as used in this specification, the singular forms "a," "an," and "the" include plural referents unless the context clearly dictates otherwise.

While there have been described herein what are to be considered exemplary and preferred examples of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A modular electronic deadbolt comprising:

a bolt module comprising:

a first housing defining a longitudinal axis;

a mounting plate coupled to one end of the first housing and configured to mount to a door edge or door frame;

a motor comprising a drive shaft and disposed in the first housing; and a deadbolt configured to extend and retract from the mounting plate along the longitudinal axis by the motor, and wherein the motor is disposed axially behind the deadbolt relative to the mounting plate and with the drive shaft substantially parallel to the longitudinal axis;

a battery module discrete from the bolt module, the battery module comprising:

a second housing configured to receive a power source;

a face plate coupled to the second housing and configured to mount to the door edge or door frame;

a cover removably coupled to the face plate and allowing access to the power source; and at least one circuit board configured to drive operation of the deadbolt of the bolt module; and a connector cable extending between the discrete bolt and battery modules such that the bolt module and the battery module are coupled in communication with each other.

2. The modular electronic deadbolt of claim 1, wherein the second housing comprises at least one spacer.

3. The modular electronic deadbolt of claim 2, wherein the at least one spacer comprises a curved portion.

4. The modular electronic deadbolt of claim 3, wherein the at least one spacer comprises a top mounting surface.

5. The modular electronic deadbolt of claim 4, wherein the top mounting surface comprises the curved portion.

6. The modular electronic deadbolt of claim 2, wherein the face plate comprises an extension, and wherein the at least one spacer extends at least partially along the extension.

7. The modular electronic deadbolt of claim 2, wherein the at least one spacer is integrally formed with the second housing.

8. The modular electronic deadbolt of claim 1, wherein the first housing has a shape that is different than that of the second housing.

9. The modular electronic deadbolt of claim 8, wherein the first housing is substantially cylindrical in shape and the second housing is substantially rectangular in shape.

10. The modular electronic deadbolt of claim 1, wherein the bolt module is a first bolt module and the modular electronic deadbolt further comprises a second bolt module substantially similar to the first bolt module and configured to couple in communication with the battery module.

11. The modular electronic deadbolt of claim 1, wherein the bolt module further comprises a leadscrew coupled to the deadbolt and axially aligned along the longitudinal axis with the motor, and at least one guide, and wherein the at least one guide surrounds at least a portion of the leadscrew and engages with the deadbolt to transfer rotational movement of the leadscrew to linear movement of the deadbolt.

12. A modular electronic deadbolt comprising:

a bolt module comprising:

a first housing, wherein the first housing is substantially cylindrical in shape;

a motor disposed in the first housing;

a leadscrew axially aligned with the motor and configured to be rotatably driven by the motor; and a deadbolt engaged with the leadscrew and configured to be linearly movable in relation to the first housing; and a discrete battery module comprising:

a second housing configured to receive a power source, wherein the second housing is substantially rectangular in shape; and a face plate coupled to the second housing and having an extension that extends therefrom, an opening is defined within the extension; and wherein the bolt module is coupled in communication with the battery module, and wherein the modular electronic deadbolt is operable in at least a first configuration and a second configuration, in the first configuration the bolt module is remote from the battery module and in the second configuration the bolt module is coupled to the battery module with at least a portion of the first housing extending through the opening of the face plate.

13. The modular electronic deadbolt of claim 12, further comprising a connector cable extending between the bolt module and the battery module.

14. The modular electronic deadbolt of claim 12, wherein the battery module further comprises at least one spacer, wherein the at least one spacer at least partially extends along the extension.

15. The modular electronic deadbolt of claim 12, further comprising a circuit board disposed in the battery module.

16. The modular electronic deadbolt of claim 12, wherein the bolt module is a first bolt module and the modular electronic deadbolt further comprises a second bolt module substantially similar to the first bolt module and configured to couple in communication with the battery module.

17. A modular electronic deadbolt comprising:

a first bolt module comprising a first housing, a first motor, and a moveable first deadbolt;

a second bolt module comprising a second housing, a second motor, and a moveable second deadbolt; and a battery module configured to operably couple to the first bolt module and the second bolt module, the battery module comprising:

a third housing configured to receive a power source;

a circuit board configured to operate both the first bolt module and the second bolt module; and a face plate having a removable cover that allows access to the power source.

18. The modular electronic deadbolt of claim 17, wherein the first housing and the second housing are substantially cylindrical in shape and the third housing is substantially rectangular in shape.

19. The modular electronic deadbolt of claim 17, wherein the battery module further includes at least one spacer, and wherein the face plate has an extension that extends from the third housing, and the at least one spacer extends at least partially along the extension.

20. The modular electronic deadbolt of claim 19, wherein the at least one spacer comprises a curved surface.

* * * * *